US006412496B1

(12) United States Patent
Gueret

(10) Patent No.: US 6,412,496 B1
(45) Date of Patent: Jul. 2, 2002

(54) EYELASH PRODUCT APPLICATOR, APPLICATOR SYSTEM AND METHOD

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 09/621,901

(22) Filed: Jul. 21, 2000

(30) Foreign Application Priority Data

Jul. 21, 1999 (FR) ..... 99 09452

(51) Int. Cl.[7] ..... A45D 40/26

(52) U.S. Cl. ..... 132/218; 132/901; 401/122; 401/129; 15/207.2

(58) Field of Search ..... 132/218, 313, 132/317, 110, 137, 901; 401/122, 126, 129; 15/206, 207, 207.2

(56) References Cited

U.S. PATENT DOCUMENTS

| | | | | |
|---|---|---|---|---|
| 155,977 | A | | 10/1874 | Rogers |
| 466,496 | A | | 1/1892 | Heysinger |
| 791,690 | A | | 6/1905 | Grell |
| 1,094,013 | A | | 4/1914 | Peterson |
| 1,580,365 | A | | 4/1926 | Bechtold |
| 1,670,161 | A | | 5/1928 | Meyer |
| 1,780,206 | A | | 11/1930 | McKellar |
| 1,829,228 | A | | 10/1931 | Lewis |
| 1,892,749 | A | | 1/1933 | Philaja |
| 1,963,389 | A | | 6/1934 | Vardeman |
| 1,989,185 | A | | 1/1935 | Clein |
| 2,077,245 | A | | 4/1937 | Locke |
| 2,175,344 | A | | 10/1939 | Friedman |
| 2,255,618 | A | | 9/1941 | Huppert |
| 2,264,346 | A | | 12/1941 | Tupper |
| 2,348,339 | A | | 5/1944 | Golden |
| 2,395,002 | A | | 2/1946 | Kemmer |
| 2,569,246 | A | | 9/1951 | Marcellus |
| 2,596,296 | A | | 5/1952 | Shields |
| 2,626,618 | A | | 1/1953 | Collison |
| 2,655,925 | A | | 10/1953 | Ulvad |
| 2,922,425 | A | * | 1/1960 | Lerner et al. ..... 132/110 |
| 3,033,213 | A | | 5/1962 | Joss et al. |
| 3,312,583 | A | | 4/1967 | Rochlis |
| 3,669,130 | A | | 6/1972 | Petroczky |
| 3,763,870 | A | | 10/1973 | Montgomery et al. |
| 3,862,639 | A | | 1/1975 | Schefer et al. |
| 3,892,248 | A | | 7/1975 | Kingsford |

(List continued on next page.)

FOREIGN PATENT DOCUMENTS

| | | |
|---|---|---|
| DE | 25 59 273 | 7/1977 |
| EP | 0 038 524 | 10/1981 |
| EP | 0 474 934 | 3/1992 |
| FR | 1 000 173 | 2/1952 |
| FR | 1 068 192 | 6/1954 |
| FR | 1 531 835 | 11/1968 |
| FR | 2 564 712 | 11/1985 |
| FR | 2 748 636 | 11/1997 |
| GB | 2 146 520 | 4/1985 |
| GB | 2 159 699 | 12/1985 |
| JP | 61-64817 | 5/1986 |
| JP | 61-194417 | 12/1986 |
| JP | 7-322915 | 12/1995 |
| JP | 9-108033 | 4/1997 |
| JP | 10-215944 | 8/1998 |
| WO | WO 95/17837 | 7/1995 |
| WO | WO 97/28719 | 8/1997 |

*Primary Examiner*—Todd E. Manahan
(74) *Attorney, Agent, or Firm*—Finnegan, Henderson, Farabow, Garrett & Dunner, LLP

(57) ABSTRACT

An applicator, applicator system and method of using an applicator for applying a product to the eyelashes include an application element disposed on the end of a stem. The application element includes a core and a plurality of consecutive teeth alternately disposed on opposite sides of the core at different positions along the length of the core. Three consecutive teeth define a volume configured to contain the product to be applied.

227 Claims, 9 Drawing Sheets

U.S. PATENT DOCUMENTS 3,896,823 A * 7/1975 Spatz ..... 132/218
3,921,650 A 11/1975 Montgomery
3,930,280 A 1/1976 Vasas
4,403,624 A 9/1983 Montgomery
4,422,986 A 12/1983 Cole
4,561,456 A 12/1985 Gueret
4,565,205 A 1/1986 Taylor
4,635,659 A 1/1987 Spatz
4,660,582 A 4/1987 Taylor
4,712,936 A 12/1987 Kessler
4,744,377 A 5/1988 Dolan, Jr.
4,804,004 A 2/1989 Taylor
5,007,442 A 4/1991 Hirzel
5,046,213 A 9/1991 Curtis et al.
5,086,793 A 2/1992 Kingsford
5,137,387 A 8/1992 Byrd et al.
5,765,573 A * 6/1998 Gueret ..... 132/317
5,918,994 A 7/1999 Gueret
5,951,185 A 9/1999 Kingsford et al.
6,053,179 A 4/2000 Lhuisset

* cited by examiner

EYELASH PRODUCT APPLICATOR, APPLICATOR SYSTEM AND METHOD

The present invention pertains to applicators, and methods using of such applicators, for applying a product. In particular, the present invention is directed toward an applicator for the application of a product, such as a cosmetic product for example, to the eyelashes or eyebrows. The invention also relates to an applicator system including the applicator and a container for containing the product to be applied. Applicators including a comb having a single row of teeth aligned along a straight line have been used to apply a make-up product.

In order to form product reservoirs which permit such a conventional applicator to be used without having to reload the make-up product onto the applicator too frequently, the teeth typically are fairly widely spaced from one another. The spacing between two consecutive teeth generally is significantly greater than the diameter of an eyelash. This configuration has the drawback of not allowing the eyelashes to be gripped by the comb very well. Thus, these conventional applicators are not able to properly smooth the product deposited at the surface of the lashes and are not capable of satisfactorily lengthening and curling the eyelashes.

Moreover, these conventional comb-like applicators often are not suitable for applying pasty or relatively low viscosity products.

Application DE-A-25 59 273 discloses a brush comprising rows of bristles connected to a support. The bristles of each row have fairly widely spaced portions connected to the support and located alternately on each side of a central line.

Application EP-A-0 474 934 discloses a brush including a number of rows of elements oriented radially, said rows being axially offset with respect to each other.

In one aspect of the present invention an applicator is provided for applying a product, for example a make-up product to the eyelashes, which is capable of satisfactorily gripping the eyelashes while at the same time holding fairly large reservoirs of product on the applicator. Preferably, this is achieved by providing an applicator having an application element that includes at least one row of teeth arranged alternately on opposite sides of a central core.

The central core provided on the applicator of the present invention tends to act as a framework and, in some embodiments, may hold the teeth on the application element. The application element according to the invention may make it possible to form reservoirs of product between the teeth while at the same time allowing the product deposited on the eyelashes to be smoothed out and the eyelashes to be gripped, lengthened, and/or separated by the teeth.

By altering the geometric configuration of the teeth, such as the tooth spacing for example, it may be possible to modify the amount of product held by the application element and thus alter the application effects of the application element in terms of the smoothing of the product and the separating and lengthening of the eyelashes. The geometric configuration of the teeth, and especially the spacing between consecutive teeth, also allows fibers that may be contained in the product to become aligned substantially so as to be substantially parallel with the eyelashes when the product is applied.

A further aspect of the invention includes an applicator as defined herein for applying makeup to the eyelashes which achieves advantages in gripping, curling, lengthening, separating, and/or loading the eyelashes.

In one embodiment according to the invention, two consecutive teeth form between them an interstice allowing the eyelashes to reach the core. As an alternative, two consecutive teeth have roots that are either substantially contiguous or overlapping, thus preventing the eyelash from freely moving between the roots or from reaching the core. In the latter embodiment, upper portions of the teeth form an interstice substantially in the form of a notch, with the notch being formed at a distance from the core. The bottoms of said notches may, for example, be at a distance greater than or equal to approximately 0.2 mm from the core.

This notch is able to grip the eyelashes to promote the lengthening or curling of the eyelash during application of the product. The expression "substantially contiguous roots" as used throughout this application should be understood as meaning the roots of the consecutive teeth do not necessarily overlap when viewed from a side of the application element, but are close enough together to prevent the free movement of an eyelash between the roots when the eyelash is inserted between consecutive teeth in a plane substantially perpendicular to the longitudinal axis of the application element. In other words, the eyelash is prevented from moving freely between substantially contiguous roots when the application element is placed in contact with the eyelashes substantially transversely. The eyelash may also be prevented from passing between substantially contiguous portions of consecutive teeth.

In another aspect of the invention, the teeth extend over substantially the entire height of the core of the application element. This is made possible by the fact that the teeth are on substantially opposite sides of a central core.

In a preferred embodiment, the envelope, i.e., the outer peripheral surface, of the application element essentially forms a substantially cylindrical surface, the directrix of which is a curve formed, for example, by the meeting of a semicircle at the bottom and an inverted V at the top (i.e., a tear drop shape).

The cross section of the core may represent less than half of the total cross section of the applicator element.

Two teeth located on the same side of the core may have disposed between them, at their lower parts, a groove configured to hold a reservoir of product with which the eyelash may come into contact during application. Thus, not only the upper portion of the teeth but also their lower portions, or roots, which connect to the core, can be used to hold and apply product. In a preferred embodiment, the groove extends at least partially on the core of the application element.

By offsetting the teeth, the teeth can be disposed on each of opposite sides of the core with a relatively wide spacing between adjacent teeth on the same side, without the application element losing its ability to grip hold of the eyelashes.

As it is withdrawn from the container, and through a wiper that may be disposed in the container, the product is contained in the cavities, i.e, volumes, formed between the teeth. The amount of product with which the application element becomes laden may thus be fairly constant from one application to the next.

According to another aspect of the invention, the teeth are deeper than they are wide, the depth being measured perpendicularly to the longitudinal axis of the core and the width parallel to the axis of the core. This allows the teeth to exhibit good mechanical strength to withstand the forces exerted by the eyelashes during application. It is thus possible to use the application element to apply a product that is likely to dry relatively quickly. Preferably, a ratio b/e is greater than or equal to approximately 1.2, and more preferably greater than or equal to approximately 1.4, where b is the depth of the root of a tooth and e is the width of the tooth.

The teeth may have a depth varying according to the axial position along the longitudinal axis of the core. Thus, the teeth may have a depth which increases, decreases, increases then decreases or vice versa, from one end of the application element to the other.

The application element may be produced at a relatively low cost by molding, preferably using plastic. In a preferred embodiment, the teeth are produced by molding plastic as a single piece with the core. The application element may include a part attached to an end of an applicator stem, such as a wand, or may be produced by molding plastic as a single piece with the applicator stem.

The application element may be produced by molding plastic as a single piece with the applicator stem and with a sealing member intended to seal the container closed when it is not being used. This sealing member preferably has a surface shaped to fit in a sealed manner into the neck of the container. Alternatively, the sealing member can be provided on a cap that is disposed on an end of the stem opposite to the application element. The cap thus being configured to sealably close an opening in the container.

The teeth preferably are arranged alternately on each side of a geometric separation surface which may be a plane, such as a mid-plane of the core for example. This geometric separation surface preferably forms a parting line for molding the application element. The geometric separation surface may alternatively be a cylindrical surface, the directrix of which is a curve or a broken line. The geometric separation surface also may be non-planar, for example twisted. The geometric separation surface may thus be a helical surface, for example.

The teeth may have an upper part extending without contact with the adjacent teeth over a relatively short height from their free end, for example over a height which is less than half their total height. A ratio b/c preferably is greater than or equal to approximately 1.2, and even more preferably greater than or equal to approximately 1.4, where b represents the depth of the root of a tooth and c represents the gap or spacing between two adjacent teeth disposed on the same side of the geometric separation surface.

A ratio of the spacing between adjacent teeth on the same side of the core and the width of the teeth, both being measured at portions of the teeth above the top surface of the core (preferably at a midportion of the teeth), ranges from approximately 0.2 to approximately 2.0.

The application element may be made of a more flexible plastic than the one used to make the applicator stem. For example, an elastomer may be used to make the application element, thus affording greater comfort in use. Alternatively, the stem may be made of a plastic which is more flexible than the material used to make the application element. It is thus possible, for manufacturing reasons, to use a relatively inflexible material to make the application element and to compensate for the inflexibility of the application element at the time of application with the flexibility of the stem.

The application element may include two parts joined together via a film hinge.

The teeth may have front and/or rear faces perpendicular to the longitudinal axis of the core, i.e., facing the ends of the core, disposed at an angle that is either acute to, obtuse to, or perpendicular to the longitudinal axis of the core.

The application element may include a first series of teeth, the front and/or rear faces of which are inclined with respect to the axis of the core, and a second series of teeth, the front and/or rear faces of which are inclined in a different way than the teeth of the first series with respect to the axis of the core, the teeth of the first series and those of the second series being arranged alternately at least partially on each side of a geometric separation surface.

The teeth may include an upper portion extending from the roots and having substantially the same axis as their roots. Alternatively the upper portion need not have substantially the same axis as the root. The upper portions, such as the free ends, may be directed respectively forward and backward. Alternatively, the teeth may include upper portions, such as free ends, directed outward, (i.e., away from each other when viewed along the length of the application element), when the application element is observed from the front. The teeth may also include upper portions, such as free ends of the teeth, (i.e., toward each other when viewed along the length of the application element), directed inward when the application element is observed from the front.

In yet another embodiment of the invention, when the application element is observed from the front along its longitudinal axis, two consecutive teeth have free ends diverging away from each other. As an alternative, when the application element is observed along its longitudinal axis, two consecutive teeth have free ends converging toward each other. In yet another alternative, when the application element is observed along its longitudinal axis, two consecutive teeth have free ends crossing one another or that are substantially parallel. Thus, the free ends of the teeth may point in the same direction. When the application element is observed along its axis, at least three consecutive teeth may have free ends aligned with one another. Moreover, the application element may include a plurality of series of consecutive teeth with a combination of consecutive teeth having diverging, converging, crossing, and substantially crossing free ends.

Two consecutive teeth may overlap each other, especially at their roots, when the application element is observed from a side.

The application element may include a first series of teeth located on one side of a geometric separation surface and a second series of teeth located on the other side of this geometric separation surface, alternating with the teeth of the first series. The teeth of the first series have either concave or convex front or rear face, that is the faces facing toward the opposite ends of the application element, facing either forward or backward, and the teeth of the second series having either a concave or convex front or rear face facing either forward or backward.

The application element may alternatively include a first series of teeth located on one side of a geometric separation surface and a second series of teeth located on an opposite side of this geometric separation surface, alternating with the teeth of the first series. The teeth of the first series have either concave or convex front or rear faces facing either forward or backward, and the teeth of the second series having a planar rear or front face.

Each of the teeth preferably has a height ranging from approximately 0.5 mm to approximately 15 mm, and more preferably ranging from approximately 7 mm to approximately 13 mm. The height of the teeth may differ from each other. For example, the height of the teeth may vary with axial position. Thus, the height of the teeth may increase, decrease, increase then decrease, or decrease then increase, or any combination thereof, from one end of the application element to the other.

The application element may have just one row of teeth, essentially forming a comb. Alternatively, the application element may include a number of rows of teeth, essentially forming a brush. A corresponding core is associated with each row of teeth in such a brush configuration.

The teeth may be produced by molding plastic with a base having either a polygonal or non-polygonal cross section and the application element may include at least one row of teeth and corresponding core extending substantially in the continuation of one side of the base in the case of a polygonal section or the roots of which connect to the base substantially tangentially in the case of a non-polygonal, for example elliptical or circular, section. An application element having such a configuration may allow the base to be used to apply the product and create a gradual contact between the eyelashes and the teeth. This application element may improve curling of the eyelashes.

The core may have a height or thickness that varies according to the axial position along the comb or the brush.

Another aspect of the invention includes an applicator for applying a product to the eyelashes comprising a stem and an application element disposed on an end of the stem. The application element includes a core having substantially opposite facing sides, a plurality of teeth alternately disposed on the substantially opposite facing sides of the core, and at least one groove located between two adjacent teeth disposed on the same side of the core. At least a portion of the groove extends on the core. A portion of the groove also may be defined by the adjacent teeth.

In one preferred embodiment, a plurality of the grooves are provided on one or both of the opposite facing sides.

The core may include a series of peaks and valleys and the groove may essentially correspond to a valley. The groove preferably is a substantially V-shaped groove opening toward a top surface of the core. Alternatively, the V-shaped groove may open toward a bottom surface of the core. The groove preferably is configured to hold the product to be applied.

In a preferred embodiment, three consecutive teeth define at least part of a volume configured to hold the product to be applied. The groove is in flow communication with the volume. The volume may be further defined by a portion of the core.

The root portions of the adjacent teeth may be connected to each other or may be separate from one another.

In yet another aspect of the invention, an applicator for applying a product to eyelashes includes a stem and an application element disposed on an end of the stem. The application element includes a core having substantially opposite facing sides, a plurality of teeth alternately disposed on the substantially opposite facing sides, and at least one volume defined by three consecutive teeth and a portion of the core. The volume is configured to contain the product to be applied with the application element and at least a portion of the volume is open to allow the eyelashes to access the product contained therein.

In one preferred embodiment, there are a plurality of the volumes and consecutive volumes alternately face in opposite directions.

The application element may further include a groove formed in one side of the core and the groove may be in flow communication with the volume defined by the three consecutive teeth. The three consecutive teeth include two teeth on a first side of the core and one tooth on a second side of the core. The volume is defined by a space between the teeth on the first side of the core. The tooth on the second side of the core may be positioned along the length of the core at a location between positions of the two teeth on the first side of the core such that the volume extends in a direction of a longitudinal axis of the core between the two teeth on the first side and in a direction substantially perpendicular to the axis between the tooth on the second side and the two teeth on the first side.

In another aspect, the invention includes an applicator comprising a stem and an application element disposed on the end of the stem. The application element includes a core having substantially opposite facing side surface portions extending in a direction parallel to a longitudinal axis of the core. The application element further includes a plurality of teeth alternately disposed on the substantially opposite facing side surface portions of the core such that at least a portion of each of the teeth on one side of the core are disposed between at least a portion of a pair of respective teeth on the opposite side of the core when the application element is viewed from the side. The top face of the core preferably is disposed intermediate a bottom end and a free end of each of the teeth, and the teeth cover at least part of the opposite facing side surface portions of the core.

The core may have a curved longitudinal axis. The core may have either a substantially uniform cross-sectional shape along its length or a cross-sectional shape varying along its length. The teeth are disposed,in a row having a longitudinal axis extending parallel to the longitudinal axis of the core.

Three consecutive teeth preferably define a volume for containing the product to be applied.

Another aspect of the invention includes an applicator for applying a product to eyelashes comprising a stem and an application element disposed on an end of the stem. The application element includes a core having substantially opposite facing sides and a plurality of consecutive teeth alternately disposed on the substantially opposite sides of the core at substantially different positions along a length of the core. Preferably, at least a portion of each of the of teeth disposed on one side of the core are disposed between at least a portion of a pair of respective teeth disposed on the opposite side of the core when the application element is viewed from the side. The width of each tooth is less than a space between two adjacent teeth on the same side of the core, the width and the space being measured at a portion of the length of the tooth extending above the core, preferably at a midportion of the teeth. Preferably, a ratio of the space to the width ranges from approximately 0.2 to approximately 2.0

An interstice may be formed between consecutive teeth when the application element is viewed from the side. The interstice may be configured such that eyelashes entering the interstice either are capable of or prevented from reaching the core.

Moreover, three consecutive teeth may define a volume configured to contain the product. A portion of the volume may be open to allow the eyelashes to contact the product contained in the volume. A portion of the volume preferably is substantially open on a side of the core where two of the three consecutive teeth are disposed and substantially closed on the side of the core where one of the three consecutive teeth, located intermediate the two teeth, is disposed.

The teeth of the application element may have various configurations, such as, for example, curved or planar faces facing toward each other (when the application element is viewed along its length) and facing away from the each other (when the application element is viewed along its length), or a tapered configuration from a root portion to a free end. Other configurations for the teeth also are contemplated and considered to be within the scope of the invention. Another aspect of the invention includes providing a system comprising any of the applicators described above and a container containing the product. The container may also include a wiper, preferably a deformable wiper chosen from a block of open cell foam and elastomeric lip.

Other aspects of the invention include a method for applying a product to eyelashes comprising providing either the systems or applicators described above, loading a product on at least some of the teeth of the applicator, and placing at least some of the teeth in contact with the eyelashes such that the product coats the eyelashes. The loading may include inserting the applicator into a container containing the product and removing the applicator from the container and wiping excess product from the teeth. Alternatively, the loading may include dispensing the product from the container onto the teeth or contacting the teeth with a solid cake of product. Preferably, the latter type of loading also includes moistening the solid cake of product. The moistening may include moistening the teeth. The method also includes gripping the eyelashes between adjacent teeth.

Another aspect of the method according to the invention includes connecting an application element to a stem, the teeth being disposed on the application element. Prior to connecting the application element, one of a plurality of application elements having teeth with various configurations may be selected to connect to the stem.

The application element of the various applicators described above may further include a base portion on which the core and the teeth are disposed.

Preferably, the applicators, systems and methods of the present invention are used to apply a cosmetic product, for example, mascara, to the eyelashes, however other products also could be used and be applied to other surfaces.

Aside from the structural and procedural arrangements set forth above, the invention could include a number of other arrangements, such as those explained hereinafter. It is to be understood that both the foregoing description and the following description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1 is an axial cross-sectional view of an applicator inserted into a container containing a product to be applied according to an aspect of the invention;

Figure 1:
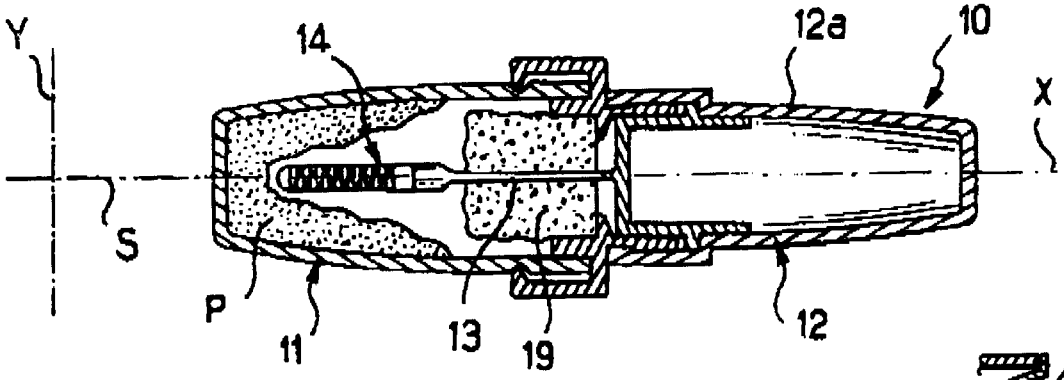
FIG. 1A is a partial cross-sectional view of an applicator system wherein the wiper is in the form of an elastomeric lip according to an aspect of the invention.

The applicator system 10 depicted in FIG. 1 includes a container 11 containing a reservoir of product P, for example a mascara of fluid to pasty consistency, and an applicator 12 comprising a stem 13 of longitudinal axis X equipped at one end with an application element 14 and at the other end with handle 12*a* for grasping. As shown, the handle 12*a* also may be in the form of a cap for closing an opening in the container 11. Preferably, a sealing member 9 is attached to either the cap 12*a* or the stem 13 to sealably close the container. If the sealing member 9 is attached to the stem, it may be molded as a single piece with the stem.

Figure 1A:
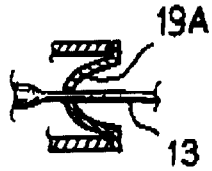

The container 11 preferably includes a wringing-out member or wiper 19 which, in the embodiment shown in FIG. 1, includes a block of open-cell foam. Alternatively, as shown in FIG. 1A, the wiper 19A may be in the form of a flexible lip, made of an elastomeric material for example, which may or may not be flocked. In either case, the wiper should be deformable such that it substantially conforms to the shape of the application element as the application element passes through the wiper when it is drawn from the container.

In the embodiment shown in FIG. 1, the application element 14 essentially is in the form of a comb 14 and is disposed essentially in continuation of the applicator stem 13. That is, an end of the application element 14 is connected to a distal end portion of the applicator stem 13 and the opposite end of the application element 14 is a free end.

Over part of its length, preferably the stem 13 has a smaller diameter than the application element 14, so as not to compress the wiper 19 when the applicator device 12 is inserted into the container.

The application element 14 may include an element allowing it to be removably connected to a housing formed on the stem 13 or may be fixed with the stem 13, such as by molding for example.

Figure 2:
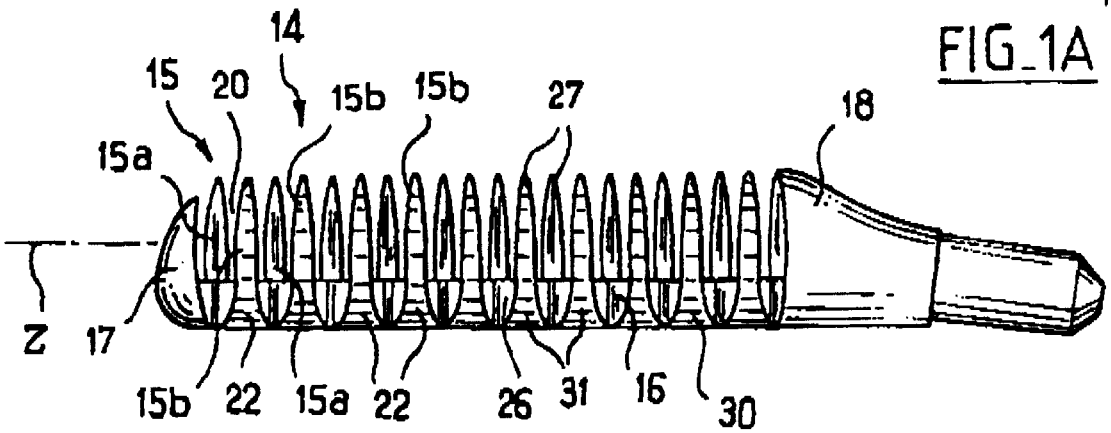
FIG. 2 is a partial side view of the applicator element of FIG. 1.

The application element 14 is depicted in isolation in FIG. 2. This application element includes a row 15 of teeth comprising a first series of teeth 15*a* and a second series of teeth 15*b* alternately disposed on opposite sides of a geometric separation surface S perpendicular to the plane of FIG. 1.

As shown, the teeth 15*a* and 15*b* are disposed alternately on opposite sides of a central core 16 of axis Z. The axis Z of the core 16 may be parallel to the axis X of the stem 13 or may be at an angle to the axis X. In fact, the axis Z of the core may even be perpendicular to the axis X of the stem as will be explained.

The teeth connect to the core 16 such that upper portions 27 of the teeth are free.

The geometric separation surface S (shown in FIG. 1) is, in the embodiment shown, a mid-plane parallel to the plane of FIG. 2. Preferably, the geometric separation surface S is also a parting line for molding the application element 14.

At a front or distal end, the application element 14 has a rounded tip 17 to make it easier to insert into the container 11. Additionally, at a rear or proximal end, the application element 14 has a boss 18 to make passage through the wiper 19 easier as the applicator is withdrawn from the container.

In the example described, the upper portions 27 of two consecutive teeth form an interstice 20 between them when the comb is observed from the side, in a direction perpendicular to the axis Z, as in FIG. 2. Over about half of the height of the teeth, the interstice 20 has a practically constant width when the application element 14 is observed from the side. The interstice 20 preferably extends as far as the core 16, and its width is great enough to allow the eyelashes to reach the core 16.

The separation between two adjacent teeth located on the same side of the core 16 may be, as shown in FIG. 2, greater than the width of a tooth, as measured approximately at mid-height of the application element 14, parallel to the axis Z.

Each tooth 15*a* on a side of the core preferably is disposed approximately midway between two adjacent teeth 15*b* disposed on the opposite side of the core 16, and vice versa, when the application element 14 is observed from the side. This configuration allows three consecutive teeth, along with the core to define a volume configured to hold the product to be applied. This volume is substantially open between the adjacent teeth on the same side of the core and substantially closed by the tooth disposed on the opposite side of the core and disposed intermediate, and preferably midway between, the adjacent teeth on the same side.

The upper portions 27 of the teeth point substantially in the same direction. The lower portions 22 of two successive teeth, located on the same side of the core 16, preferably form between them and with the core 16 a groove 26 intended to hold some product for depositing on the eyelashes. The application element 14 is thus essentially hollowed at the lower part, between two teeth 15*a* or 15*b*.

The interstices 20 between consecutive teeth should be small enough to make it possible to grip hold of the eyelashes, separate them, comb them, and smooth out the product deposited on the eyelashes.

It will be understood that by altering the length of the teeth or the spacing between adjacent teeth on the same side, it is possible to alter the amount of product with which the comb becomes laden.

The separation between the adjacent teeth on the same side, for example in either of the series 15*a* or 15*b*, may thus be relatively large in order to increase the amount of product with which the application element becomes laden without the application element losing its ability to grip the lashes, provided that the interstices 20 formed by the upper parts 27 of the teeth remain narrow enough, for example narrower than the mean width of the upper portion 27 of a tooth. It will be noted from examining FIG. 2 that, in the example described, the root portions 31 of the teeth 15*a* or 15*b* widen to meet the root portions of adjacent teeth at the lower end 30 of the application element 14. Thus, grooves 26 are formed between adjacent teeth on the same side of the core. These grooves are configured to hold product and may open into the volume defined by three consecutive teeth and the core, allowing the eyelash to have access to a significantly greater amount of product disposed on the application element.

Figure 9:
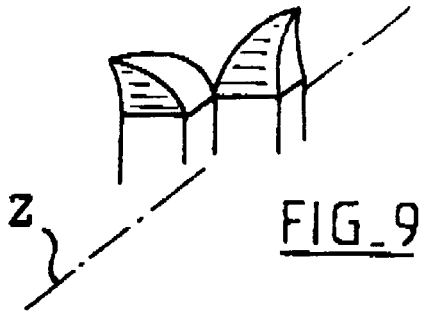
FIG. 9 is a partial perspective view of two consecutive teeth according to an aspect of the invention.
Figure 10:
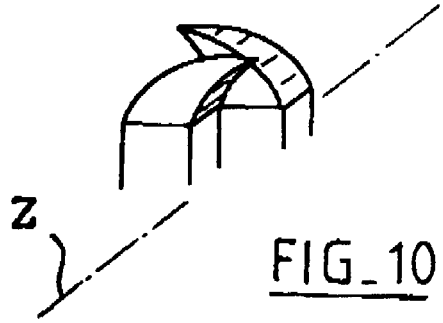
FIG. 10 is a partial perspective view of two consecutive teeth according to another aspect of the invention.
Figure 11:
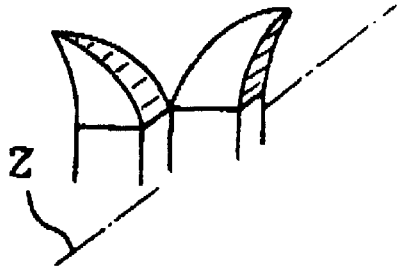
FIG. 11 is a partial perspective view of two consecutive teeth according to yet another aspect of the invention.

In general, consecutive teeth alternately disposed on each side of the central core may have upper portions with numerous configurations without departing from the scope of the present invention. For example, the upper portions of the teeth may be inclined forward and backward alternately, as illustrated in FIG. 9. The upper portions of the teeth may alternatively be directed toward each other when the application element is observed along the longitudinal axis, as illustrated in FIG. 10. The upper portions also may cross each other. Alternatively, the upper portions may diverge from one another, as illustrated in FIG. 11. The upper portions may include a substantially length of the teeth extending from the roots or may be only the free ends of the teeth, as shown in FIGS. 9–11.

The teeth may thus, when the application element is observed along the longitudinal axis, diverge gradually in a direction away from the central core, on which they are disposed.

The tooth configuration may be chosen according to the type of makeup effect desired and the kind of product to be applied to the eyelashes.

Figure 3:
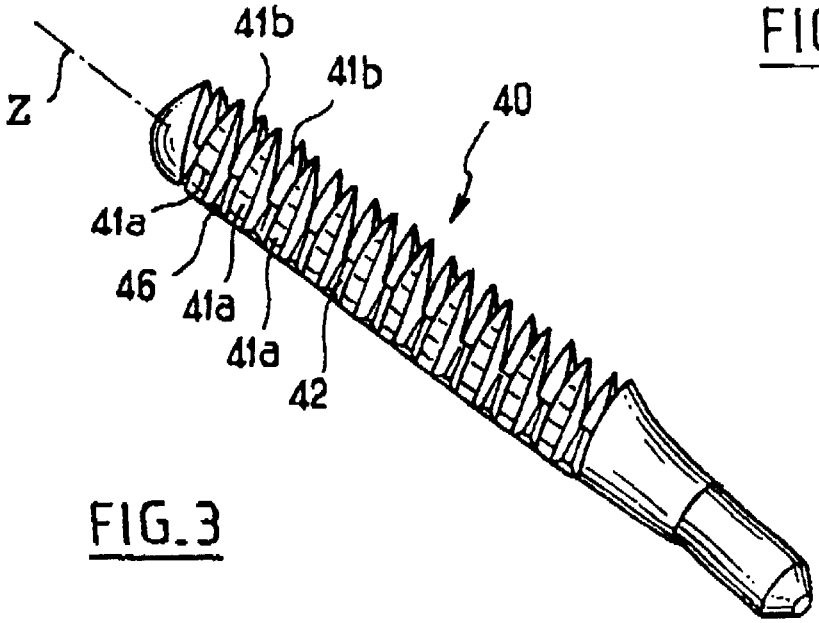
FIG. 3 is a partial perspective view of an applicator according to the another aspect of the invention.
Figure 4:
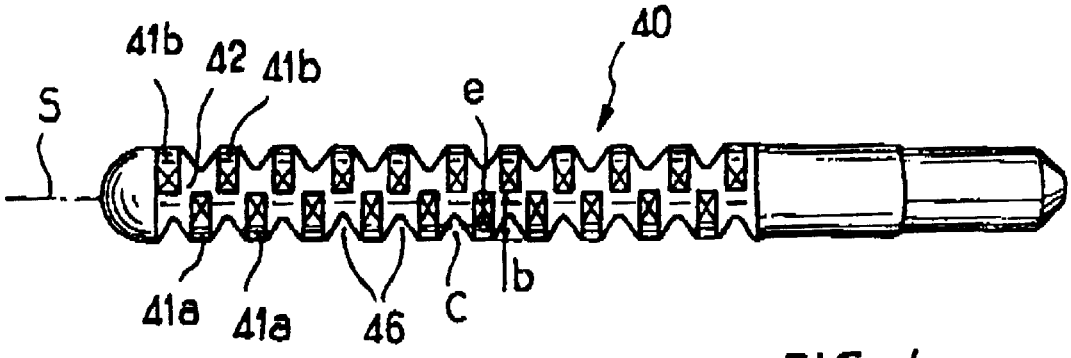
FIG. 4 is a top view of the applicator of FIG. 3 showing grooves and volumes.

The application element 40 depicted in FIGS. 3 and 4 includes a row of teeth 41*a,* 41*b* disposed respectively on substantially opposite facing sides of a central core 42. As with the application element discussed with reference to FIG. 2, the application element 40 essentially is in the form of a comb. When this comb 14 is observed from the side, the teeth 41*a* alternate with the teeth 41*b* along the axis Z of the core 42. That is, the teeth of the series 41*a* are disposed substantially in between the teeth of the series 41*b,* and vice versa, when the application element 14 is observed from the side.

As shown in FIG. 4, grooves 46 with a V-profile when the comb 40 is observed from above are made in the core 42 between adjacent teeth 41*a* or 41*b* disposed on the same side of the core. As with the grooves of FIG. 2, the grooves 46 essentially add to the volume formed by the core and three consecutive teeth, thus permitting the eyelashes to have greater access to the product on the application element.

The teeth 41*a,* 41*b* preferably are deeper than they are wide in this embodiment, the width e being measured parallel to the axis Z and the depth b perpendicular to the latter into the plane of the figure. The spacing c between two successive teeth 41*a* or 41*b* also preferably is greater than the width e.

By virtue of their relatively deep roots, the teeth 41*a,* 41*b* are capable of withstanding strain exerted transversely to the axis Z, which means that the eyelashes can be separated and the product deposited at their surface smoothed out even when the product used has partially dried or is relatively viscous. In these embodiments, the root portions of the teeth 41*a* or 41*b* do not meet, unlike the case of the embodiment of FIG. 2.

Figure 5:
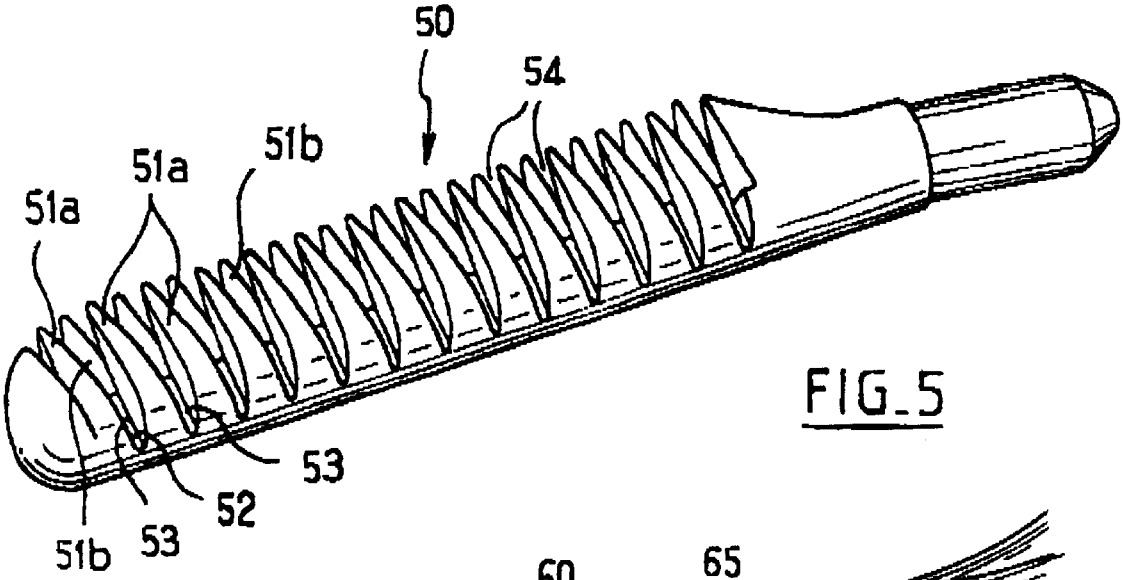
FIG. 5 is a partial side view of an applicator according to yet another aspect of the invention.

FIG. 5 depicts an application element 50 essentially in the form of a comb including a row of consecutive teeth 51*a,* 51*b* produced alternately on each side of a central core 52. Grooves 53 are produced between the teeth 51*a,* 51*b* located on the same side of the core 52. However, unlike the application elements depicted in FIGS. 2 and 3, the teeth 51*a* and 51*b* overlap when the application element is observed from the side.

Only the upper portions of the teeth, of tapered shape, do not overlap, creating interstices 54 between consecutive teeth 51*a* and 51*b*. These interstices 54 are essentially in the form of V-shaped notches able to grip hold of the eyelashes. The bottoms of these notches are spaced from the core 52, the eyelashes thus being prevented from reaching the core 52. Preferably, the bottoms of the notches are spaced at a distance of at least approximately 0.2 mm above a top surface of the core 52.

The free upper portions of the teeth in this embodiment preferably represent only about one third of the total height of the application element. A fairly substantial amount of product can accumulate between the consecutive teeth in each of the series of teeth 51*a* or 51*b* and the eyelashes may easily be brought into contact with the reservoirs of product thus formed during use to become laden with product, the product deposited on the eyelashes being smoothed out by the gripping of the eyelashes between the notches 54.

Figure 6:
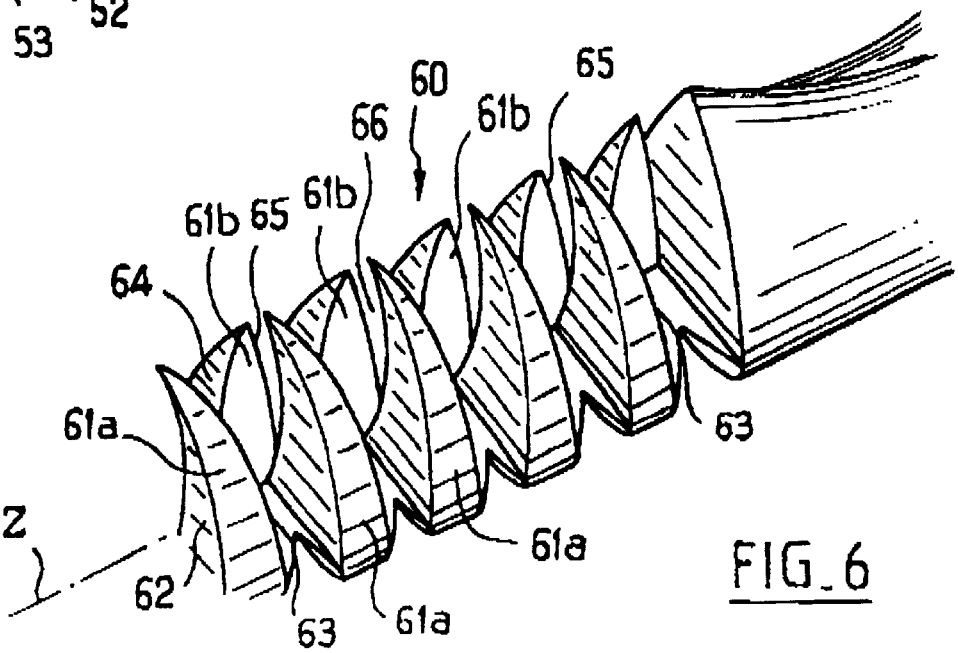
FIG. 6 is a partial perspective view of an applicator according to an aspect of the invention.

The teeth connected to the core may have different geometries. By way of example, FIG. 6 depicts an application element 60, again in the form of a comb, comprising a first series of teeth 61*a* and a second series of teeth 61*b* alternating with the first. The teeth 61*a* have concave front faces 62 facing forward and convex rear faces 63 facing backward, whereas the teeth 61*b* have convex front faces 64 facing forward and substantially planar rear faces 65 facing backward.

The upper portions of two consecutive teeth constitute notches 66 in which the eyelashes can engage when product is being applied, the edges of these notches converging toward the core that bears the teeth such that the eyelashes can be gripped by the comb.

In alternative forms, not shown in the figures, the front faces 62 of the teeth 61*a* may be convex facing forward and the rear faces 63 of the teeth 61*a* may be concave facing backward, while the front faces 64 of the teeth 61*b* may be concave facing forward, or even planar, and the rear faces 65 may be concave or convex facing backward. Other combinations of the geometric configuration of the teeth also are contemplated and considered to be within the scope of the invention. In fact, series of consecutive teeth having differing configurations may constitute a row.

Figure 12:
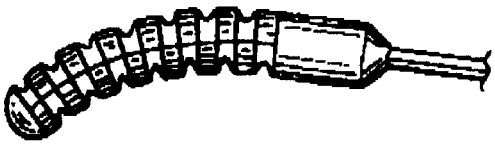
FIG. 12 is a top perspective view of an applicator according to another aspect of the invention.

The core to which the teeth are connected is not necessarily straight and may have a longitudinal axis extending in a curved or broken line. For example, FIG. 12 depicts an alternative form of the application element of FIG. 4, in which the longitudinal axis of the core extends essentially in an arc of a circle. In FIG. 12, the geometric separation surface on each side of which the teeth extend is a cylindrical surface with a directrix coincident with the axis of the core and a generatrix perpendicular to the plane of FIG. 12.

Figure 13:
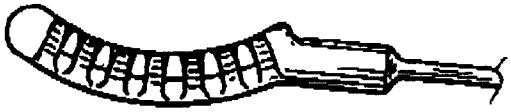
FIG. 13 is a side perspective view of an applicator according yet another aspect of the invention.

As an alternative, the core may be curved about an axis oriented at right angles to the geometric separation surface, such as the axis Y in FIG. 1. An application element with a core curved in this way is depicted in FIG. 13.

The application element may include a single row of teeth and form a comb, as is the case of the embodiments which have just been described, or alternatively may include a number of rows of teeth and essentially form a brush.

Figure 7:
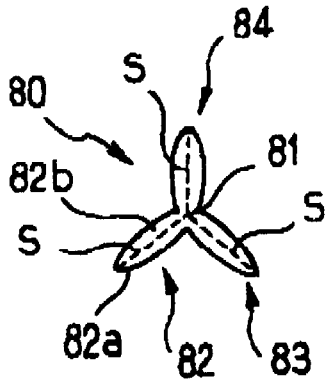
FIG. 7 is a cross-sectional view of a brush applicator according to an aspect of the invention.

One example of such a brush is shown in FIG. 7, wherein an application element 80 forms a brush with a central core 81 having a longitudinal axis perpendicular to the plane of FIG. 7. On this core, three rows of teeth 82, 83, 84 are disposed. Each row 82, 83 or 84 includes a first series of teeth and a second series of teeth produced respectively on each side of a core associated with the row. Thus, the row 82 includes teeth 82*a,* 82*b* which are produced alternately on each side of a core which is integral with the middle core 81.

The teeth 82*a* and 82*b* are located alternately on each side of a geometric separation surface S formed by a radial plane. The same is true of the other rows of teeth 83 and 84. The teeth are thus oriented substantilly radially from the core. However, the teeth may have orientations other than a radial orientation.

Figure 8:
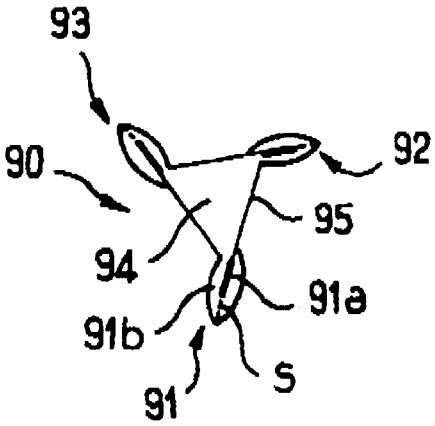
FIG. 8 is a cross-sectional view of a brush applicator according to another aspect of the invention.

By way of example, FIG. 8 depicts an application element 90 having three rows of teeth 91, 92, 93, wherein each row of teeth is connected to a base 94 having a substantially triangular cross section. The teeth of each row 91, 92 or 93 are produced alternately on each side of a respective central core associated with each row.

The row of teeth 91 includes a first series of teeth 91*a* and a second series of teeth 91*b* located alternately on each side of a geometric separation surface S, the teeth 91*a* and 91*b* being molded as a single piece with the base 94. The geometric separation surface S for the row of teeth 91 is a plane which extends practically parallel to a side 95 of the base 94. The same is true of the rows of teeth 92 and 93 which thus each extend substantially in the continuation of a side. The three rows thus being oriented in the same direction of gyration about the axis of the base 94.

Figure 8A:
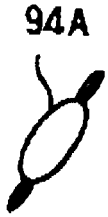
FIG. 8A is a cross-sectional view of a brush applicator with a non-polygonal base portion according to an aspect of the invention.

Alternatively, as shown in FIG. 8A, the rows of teeth could be connected to a non-polygonal base portion 94A. The roots of the teeth in each row can extend either substantially radially from the core or tangentially to the core.

Figure 14:
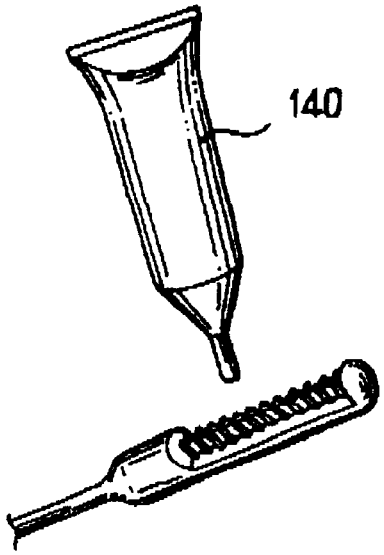
FIG. 14 is a perspective view of another embodiment of an applicator system according to the present invention wherein the product to be applied is dispensed onto the application member from a flexible tubular container.
Figure 15:
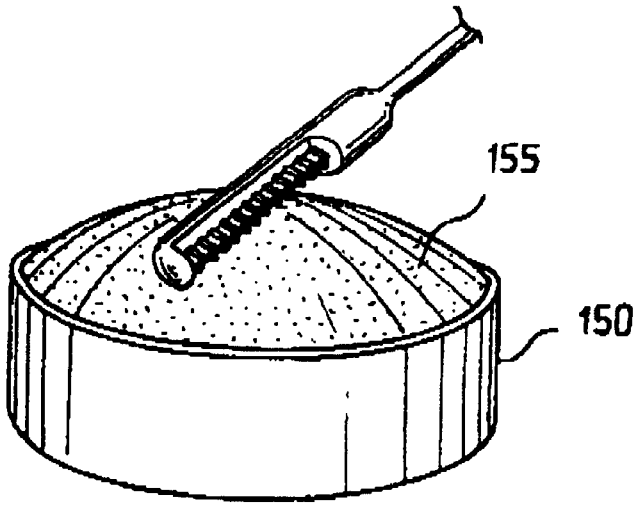
FIG. 15 is a perspective view of yet another embodiment of an applicator system according to the present invention wherein the product to be applied is in the form of a cake or powder.

Alternatives to the applicator system discussed with respect to FIG. 1 are shown in FIGS. 14 and 15. FIG. 14 illustrates an applicator system in which the product is stored in a tube-like container 140. This tube preferably is made of a flexible material which when squeezed can dispense product onto the application element of the applicator device. Other dispensers also can be used to dispense the product onto the application element, such as a pump-type dispenser for example, and are considered within the scope of the invention. The applicator system shown in FIG. 15 includes a container 150 holding a solid cake of product 155. To load the application element, the application element is run through this product 155. This solid cake preferably can be moistened and the application element run through the moistened part of the product to load the product onto the applicator device. Alternatively, the application element can be moistened and run through unmoistened product. For the embodiments shown in FIGS. 14 and 15, it is not necessary to equip the proximal end of the applicator device with a handle or a cap, as the applicator device is not stored in the container containing the product and does not close off such a container. Moreover, in these embodiments, the stem itself can be used as a handle.

Figure 16:
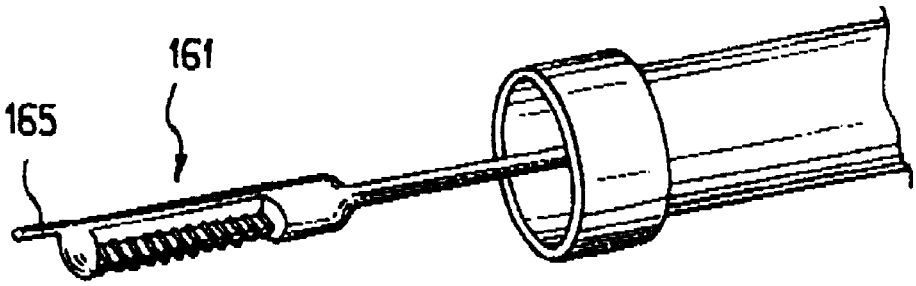
FIG. 16 is a perspective view of an applicator according to another aspect of the invention wherein the distal end of the application member includes a substantially pointed tip.

FIG. 16 illustrates yet another aspect of the applicator device of the present invention. The applicator device shown in FIG. 16 includes a pointed tip 165 extending from the distal end of the application element 161. Upon loading the application element 161 with product, the pointed tip 165 may also become loaded with product and can serve as a tool to line the eyes or as a picking device to pick through individual lashes.

Figure 17:
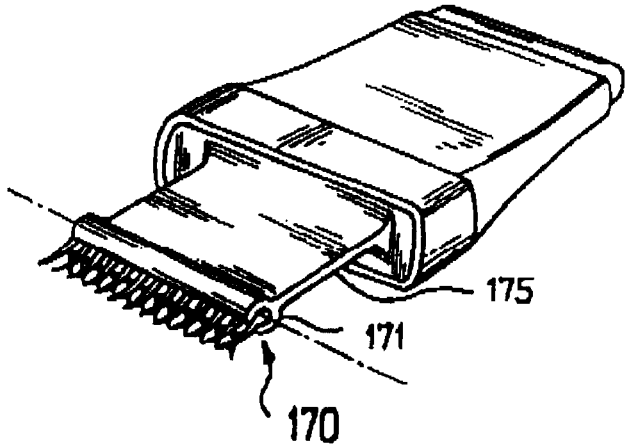
FIG. 17 is a perspective view of an applicator having an application element with a longitudinal axis directed perpendicularly to a longitudinal axis of the applicator stem and wherein the application element is insertable into a housing formed at a distal end portion of the applicator stem.
Figure 17A:
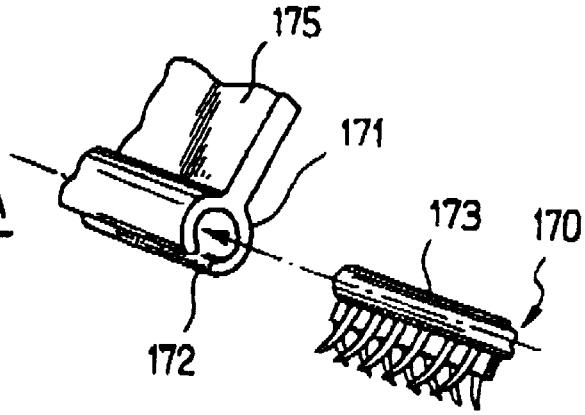
FIG. 17A is a partial close-up perspective view showing the application element prior to insertion in the housing of the applicator stem.
Figure 18:
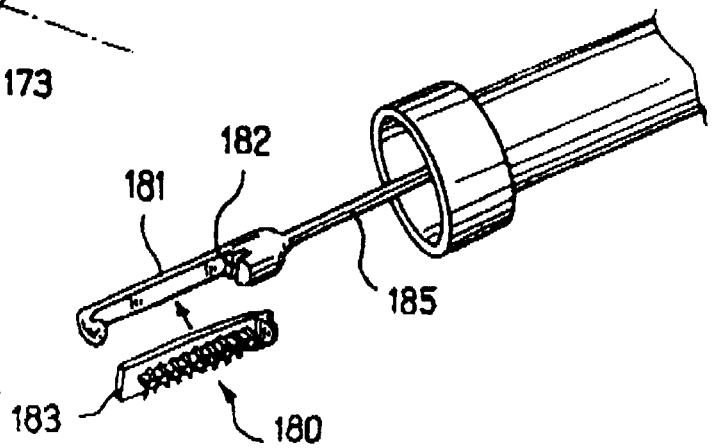
FIG. 18 is a perspective view of an applicator wherein the application element is removably engageable with a distal end portion of the stem according to another embodiment of the invention.

FIGS. 17, 17A, and 18 show embodiments of an applicator in which the application element is configured to be removably connected to the stem. The application element 170 shown in FIGS. 17 and 17A includes a base portion 173 on which a core and a row of teeth alternately disposed on opposite sides of the core are disposed. The base portion 173 is configured to be inserted into a connector 171 in the form of a housing or enclosure formed at a distal end portion of the applicator stem 175. FIG. 17A illustrates the inserting of the base portion 173 of the application element into the connector 171.

The housing 171 may define a slot 172 at the front or distal end portion of the stem to allow the passage of the roots and a portion of the core of the application element. Preferably the width of this slot is such that the roots of the teeth of the application element are clamped between opposite edges of the slot. This mounting allows the application element to be made of an elastomeric plastic and the stem 175 of a rigid or semirigid plastic.

As shown in FIG. 17 and 17A, a longitudinal axis of the application element 170 is disposed substantially perpendicular to a longitudinal axis of the stem 175. The application element 170 is attached to a distal end portion of the stem 175 on a portion located between two ends of the application element.

FIG. 18 shows another embodiment of the applicator wherein the base portion 183 of the application element 180 can be removably connected to a connector housing 181 formed at a distal end portion of a stem 185. Again the housing 181 essentially defines a slot 182 with which the base portion of the application element is engageable. In contrast to the embodiment shown in FIGS. 17 and 17A, an end of the application element 180, when inserted into the connector 181, is connected to a distal end portion of the stem 185. In FIG. 18, the longitudinal axis of the application element 183, once inserted into the connector 181, extends in substantially the same direction as the longitudinal axis of the stem 175. The application element may also extend at an angle to the stem, with an end of the application element still being connected to the distal end portion of the stem.

Figure 19:
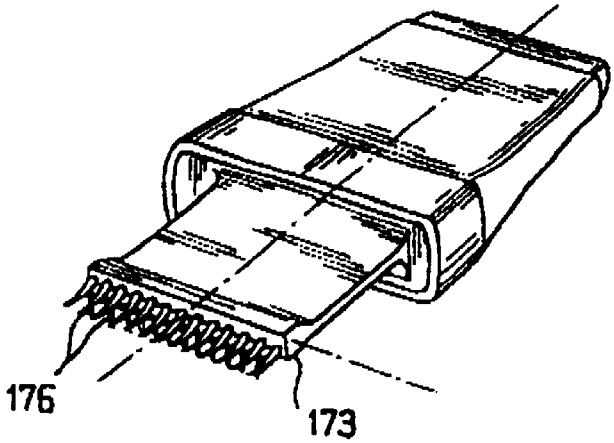
FIG. 19 is a perspective view of an applicator device similar to the one shown in FIG. 17 except wherein the application element is formed as a single piece construction with the stem.

FIG. 19 shows an applicator similar in configuration to the applicator of FIG. 17. In the embodiment shown in FIG. 19, the base portion 173 is essentially formed as a single piece molded structure with the stem 175. Similarly, the teeth 176 can be molded as a single piece with the base portion 173 and stem 175.

Figure 20:
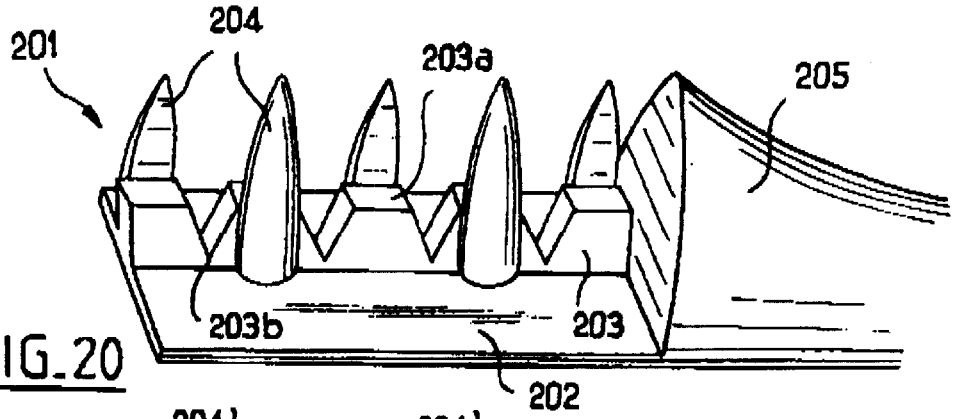
FIG. 20 is a partial perspective view of an applicator having the core and teeth disposed on a base portion of an application element according to an aspect of the invention.

FIG. 20 illustrates yet another embodiment of an applicator according to the present invention. The applicator includes an application element 201 attached to a distal end of a stem 205. The application element 201 includes a base portion 202 on which a core 203 and a row of consecutive teeth 204 are disposed. The consecutive teeth 204 are alternately disposed on opposite sides of the core. The core 203 varies in height with an axial position along the longitudinal axis to form a series of peaks 203*a* and valleys 203*b* along the length of the core. The teeth 204 are disposed at axial positions along the core 203 substantially corresponding to the peaks 203*a*.

Figure 21:
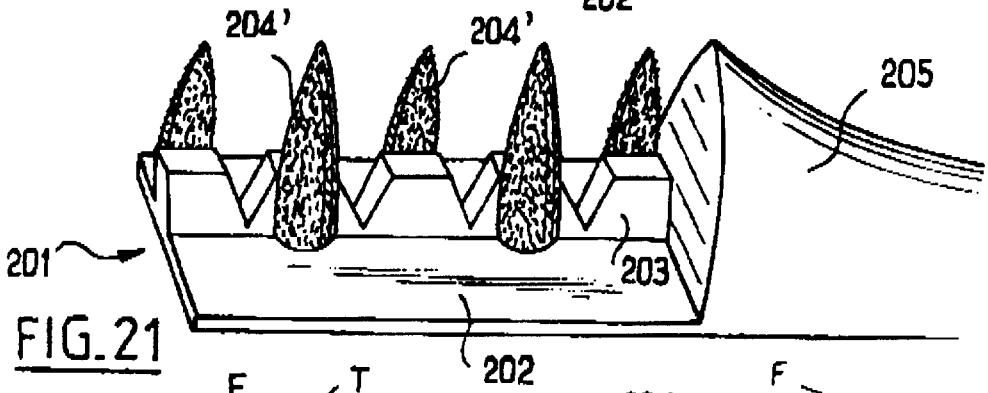
FIG. 21 is a partial perspective view of an applicator device similar to the one shown in FIG. 20 wherein the teeth have flocking.
Figure 22:
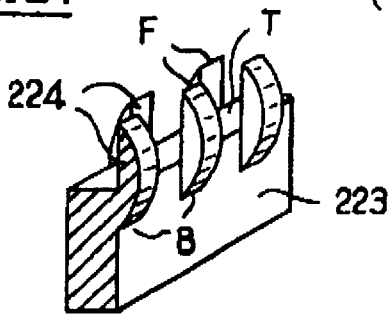
FIG. 22 is a partial perspective view of an application element wherein the teeth are disposed so as to cover only a portion of the height of the core according to an aspect of the invention.

The valleys 203*b* essentially form grooves located between the adjacent teeth located on the same side of the core 203, as well consecutive teeth located on opposite sides of the core 203. These grooves are capable of holding the product to be applied. FIG. 21 illustrates a similar applicator as that shown in FIG. 20, with the exception that the teeth 204' are flocked. This flocking can either be applied to the teeth essentially in the form of a coating or be mixed in with the material used to form the teeth. Although not shown in FIG. 21, the core and the base portion of the applicator also may be flocked. In both FIGS. 20 and 21, the base portion on which the teeth and core are disposed is relatively wide and extends laterally outward by a relatively large amount past outer surfaces of the teeth and core.

Figure 29:
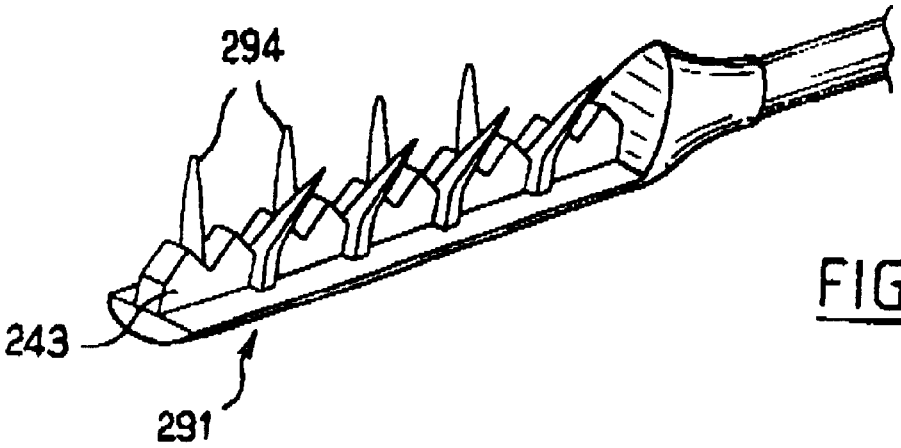
FIG. 29 is a partial perspective view of an applicator according another aspect of the invention.
Figure 30:
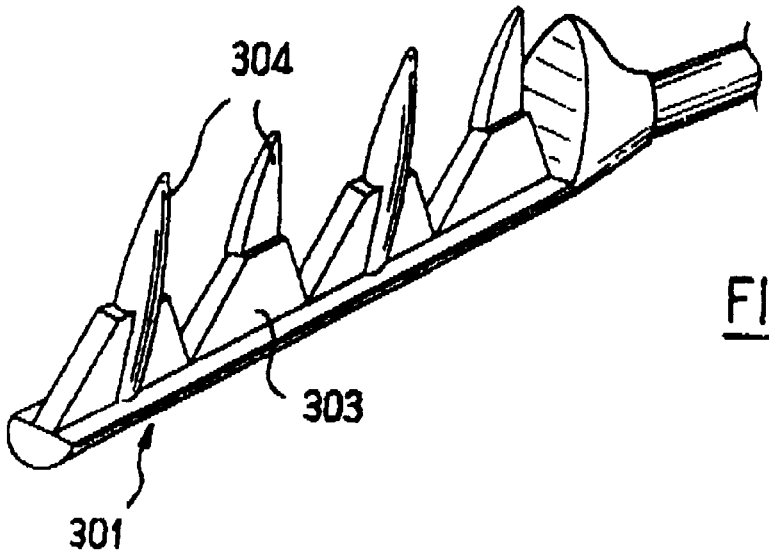
FIG. 30 is a partial perspective view of an applicator according to yet another aspect of the invention.
Figure 31:
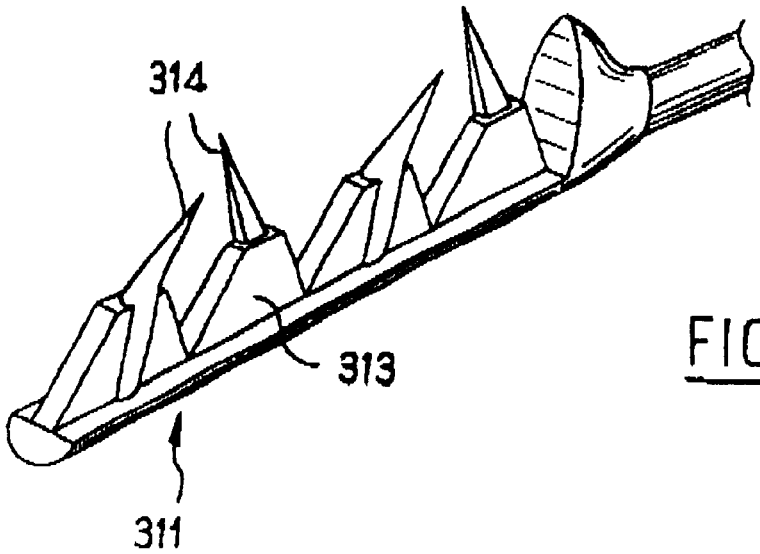
FIG. 31 is a partial perspective view of an applicator according to yet another aspect of the invention.

FIGS. 29–31 show other application elements 291, 301, 311 wherein the height of the core 293, 303, 313 varies along its length. Again, these variations in height tend to form valleys and peaks along the core, the valleys essentially forming grooves disposed between adjacent teeth on the same side of the core and also between consecutive teeth on opposite sides of the core. In FIGS. 29–31, the base portion on which the core and teeth are disposed is relatively narrow and not much greater than the distance measure across the core from one consecutive tooth to another. Consecutive teeth 294, 314 in FIGS. 29 and 31 have upper portions extending from the roots that diverge away from each other when the application element is observed along its longitudinal axis. In FIG. 30, the upper portions of the teeth 304 extend substantially straight. Although not shown, consecutive teeth alternately having upper portions diverging and extending straight also is contemplated by the invention. In fact, any combination of converging free ends, diverging free ends, substantially straight free ends, and crossing free ends when the application element is observed along the longitudinal axis is considered to be within the scope of the invention.

Figure 23:
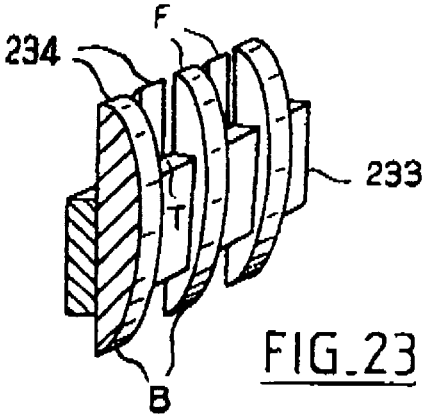
FIG. 23 is a partial perspective view of an application element wherein the teeth are disposed so as to cover the entire height of the core according to an aspect of the invention.
Figure 24:
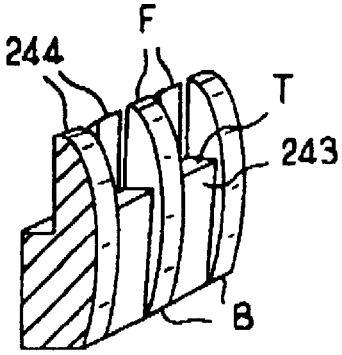
FIG. 24 is a partial perspective view of an application element wherein the teeth are disposed such that an end of the teeth are flush with a bottom of the core according to another aspect of the invention.
Figure 25:
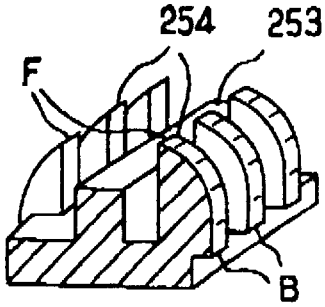
FIG. 25 is a partial perspective view of an application element wherein the teeth are disposed on opposite sides of a T-shaped core according to another aspect of the invention.

FIGS. 22–25 show various configurations for the disposition of the teeth relative to the core. In each of the configurations shown in FIGS. 22–25, the teeth (24, 234, 244, 254 and the core 223, 233, 243, 253 are disposed relative to one another such that a top surface T of the core is between a bottom end B and a free end F of the teeth. The teeth are disposed alternately on opposite facing sides of the core. FIG. 23 also shows an application element wherein the teeth are molded using a material different from that used to mold the core.

Figure 26:
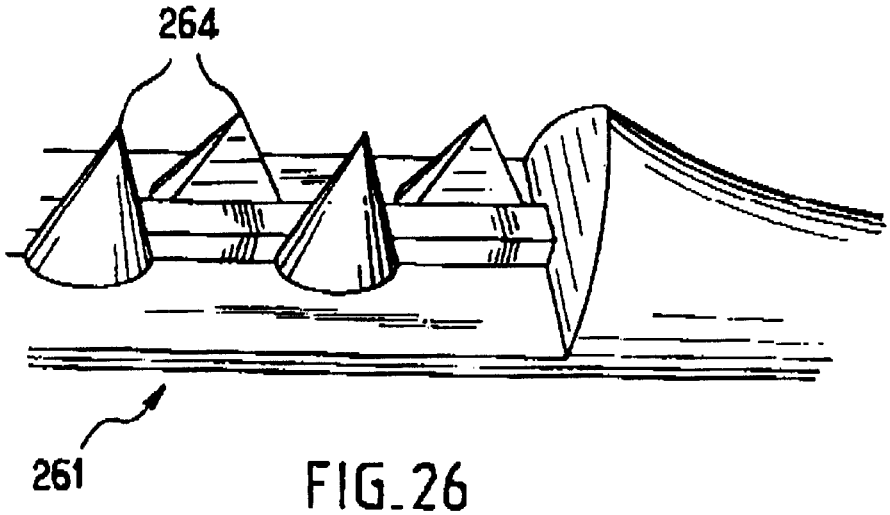
FIG. 26 is a partial perspective view of an applicator device according to the invention wherein the teeth and core are disposed on a base of the application element and the teeth have conical shape.
Figure 27:
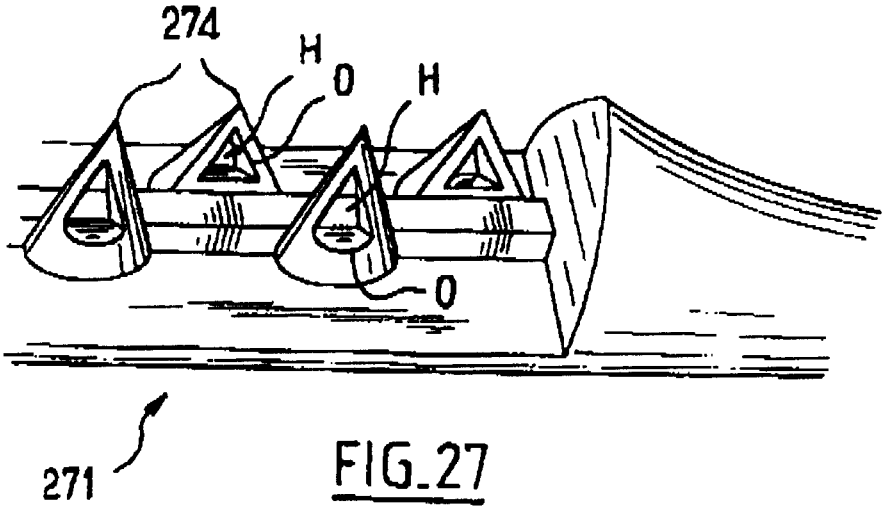
FIG. 27 is a partial perspective view of an applicator device similar to the applicator device shown in FIG. 26 wherein the teeth have hollow portions.

FIGS. 26 and 27 show embodiments of an applicator in which the teeth 264, 274 have relatively wide root portions and significantly taper toward their free ends. When the application element 261, 271 is observed from the side, the roots of consecutive teeth are substantially contiguous while the free ends of consecutive teeth are spaced relatively widely from each other. In FIG. 27, the teeth 272 have hollow portions H extending along a portion of their lengths. Openings O on each side of the tooth lead to the hollow portion. Although in FIG. 27 openings are located on both sides of the teeth, an opening on just one side of the tooth also is contemplated by the invention. The openings and hollow portions in the teeth permit the application element to hold an even greater amount of product.

Figure 28:
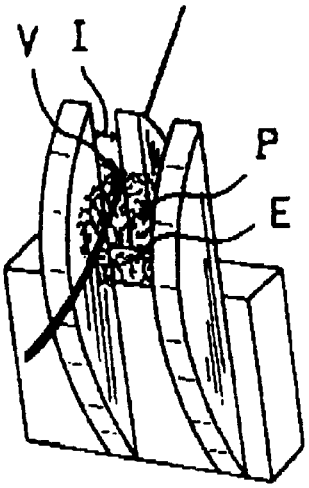
FIG. 28 is a perspective view of three consecutive teeth of FIG. 24 showing the access of an eyelash to the product contained in a volume formed between the teeth according to an aspect of the invention.

FIG. 28 illustrates how three consecutive teeth disposed alternately on opposite sides of a core may be configured to form a volume V for holding the product P. In the configuration of the teeth and core shown in FIG. 28, the portions of consecutive teeth extending above the core form an interstice between them configured such that the eyelashes E entering the interstice are capable of reaching the core. However, the interstice I also is configured to essentially grip the eyelashes E to achieve lengthening and curling of the eyelashes.

Figure 32:
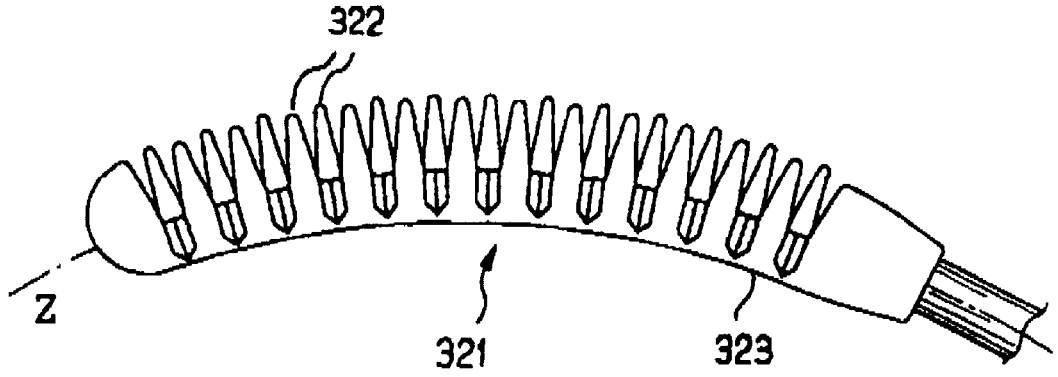
FIG. 32 is partial perspective view of an applicator device having flexible application element according to an aspect of the invention.
Figure 33:
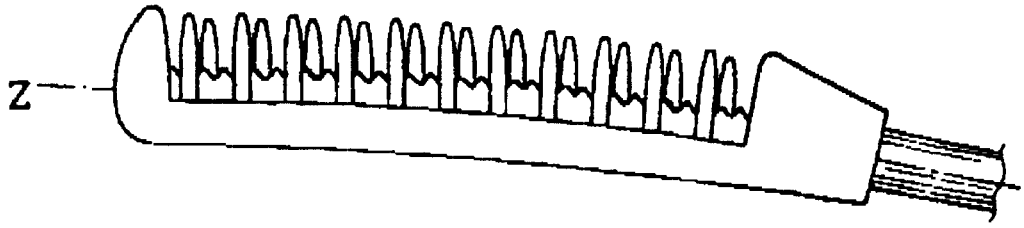
FIG. 33 is a partial perspective view of an applicator device according to an aspect of the invention.

As mentioned above, the application element may have a curved longitudinal axis Z, as shown in FIG. 32, or may have a straight longitudinal axis Z, as shown in FIG. 33. Moreover, the application element may be made of a flexible material so that it is able to bend during application. Such a flexible application element also is illustrated in FIG. 32. The application element 321 in FIG. 32, including a base portion 323, has a curved longitudinal axis with a convex surface on which the teeth 322 are disposed. This convex surface configuration causes the teeth to diverge away from each other, thus allowing a relatively large amount of product to be contained between adjacent teeth and consecutive teeth. Moreover, the applicator shown in FIG. 32 may achieve improved loading of the teeth with the product as the application element is withdrawn through a wiper. This is because the force of the wiper on the application element will tend to straighten the axis of the application element and cause the teeth to move toward each other, particularly toward a middle portion (along the length) of the application element. As the teeth move toward each other, product may be forced between the teeth toward the roots of the teeth and the base portion, again allowing the application element to hold a relatively large amount of product.

Figure 34:
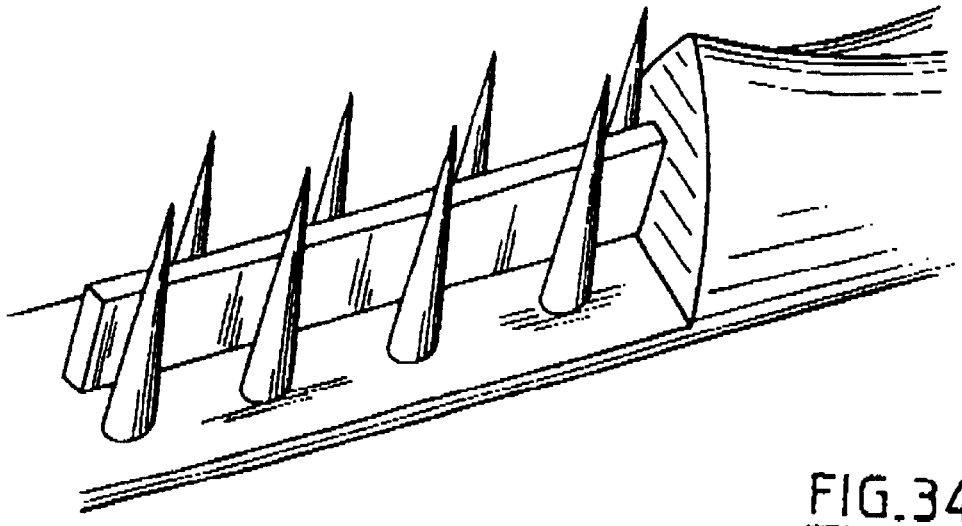
FIG. 34 is a partial perspective view of an applicator device according to yet another aspect of the invention.

As is apparent from the various figures shown and described, the teeth and core may have a variety of geometrical configurations without departing from the spirit and scope of the invention. For example, the teeth can be relatively narrow with spiked free ends, as shown in FIG. 34, or can have more rounded free ends, such as those shown in FIGS. 32 and 33. Other geometries are shown in the drawings and have been described. Also as shown in FIG. 34, the teeth may be disposed such that they are laterally spaced from the core.

The invention is not restricted to the examples and embodiments which have just been described. Rather, it is possible for at least some of the features of these examples and embodiments to be combined into one and the same applicator. In general, the particular features of each of the embodiments described may be combined, according to the type of product to be applied and the application effect desired.

The invention is not restricted to the embodiments which have just been described. For example, the teeth may have shapes other than those that have been described and the teeth on a particular application element or in a particular row need not have the same shape as each other. For example, the application element may include a succession of consecutive teeth including a first and a second series of teeth which alternate, the teeth of the first series having a different shape, than the teeth of the second series.

Moreover, teeth of the same series also may be made up of teeth with different shapes or even different heights. The teeth may, for example, have a height which varies according to the axial position along the application element, for example a height which increases, decreases, decreases then increases or increases then decreases from one end of the application element to the other.

The application element may have a surface condition to increase the amount of product with which the application element becomes laden. For instance, the teeth, the base portion, and/or the core may include capillary grooves or flocking, over all or parts of their surface. An example of such flocking on the teeth is shown in FIG. 21.

The teeth may undergo a surface treatment by abrasion so as to form forks at the ends of the teeth, for example or may undergo a heat treatment to, for example, round their tips or form a bobble at their free end. The teeth thus become less aggressive toward the eyelashes.

The teeth, core, and/or base portion may be coated with a gliding agent, such as a lacquer or Teflon, for example, to make them glide better along the eyelashes or, alternatively, to give them greater roughness. Such gliding agents may alternatively, or in addition be added to the material used to form the teeth.

The application element, and especially the teeth, may also include active ingredients, such as preservatives, moisturizers, copper salts, magnetic particles, and other similar suitable materials, to be released into the product when the product is loaded onto the application element. These active ingredients can either be included in the material used to form the application element, or can be coated onto the application element, or both. In addition, products can be used to form the teeth or core or to coat the teeth or core that modify the surface tension of the application element upon contact with moisture.

The application element is preferably made by the injection-molding of plastic, but as an alternative, use may be made of methods for shaping material by compression, stamping or turning.

The base portion may also include grooves or reliefs configured to hold the product.

Although numerous configurations for the teeth and core are contemplated by the invention, in each of the embodiments described, preferably the length of a row of consecutive teeth will range from approximately 10 mm to approximately 45 mm, and more preferably from approximately 15 mm to approximately 28 mm, and even more preferably from approximately 20 mm to approximately 26 mm. The individual lengths of each tooth will preferably range from approximately 0.5 mm to approximately 15 mm, and more preferably from approximately 7 mm to approximately 13 mm. The number of teeth in a row of consecutive teeth will preferably range from approximately 6 to approximately 50, and more preferably from approximately 10 to approximately 35, and even more preferably approximately 15 to approximately 32.

It will be apparent to those skilled in the art that various modifications and variations can be made to the structure and methodology of the present invention without departing from the scope or spirit of the invention. Thus, it should be understood that the invention is not limited to the embodiments and examples discussed in the specification. Rather, the present invention is intended to cover modifications and variations of this invention, provided they fall within the scope of the following claims and their equivalents.

What is claimed is:

1. A system for applying a product to eyelashes, comprising:

a container configured to contain a product;

an applicator including a stem, and an application element at one end of the stem, the application element including a core having substantially opposite facing sides, and at least one row of teeth, wherein the at least one row of teeth comprises a row of teeth alternately disposed on the substantially opposite facing sides of the core, wherein each of the alternately disposed teeth comprises a first end portion and a second end portion opposite to the first end portion along a tooth length, and wherein at least a portion of the core is located above the first end portion and below the second end portion when the application element is oriented such that the second end portion is above the first end portion.

2. The system of claim 1, wherein an interstice is formed between upper portions of at least two consecutive teeth.

3. The system of claim 2, wherein the interstice is configured such that eyelashes entering the interstice are capable of reaching the core.

4. The system of claim 2, wherein the interstice is configured such that eyelashes entering the interstice are not capable of reaching the core.

5. The system of claim 4, wherein the interstice is essentially in the form of a notch formed by upper portions of at least two consecutive teeth.

6. The system of claim 5, wherein the notch is V-shaped.

7. The system of claim 6, wherein a bottom of the notch is disposed at a distance of at least approximately 0.2 mm from a top of the core.

8. The system of claim 5, wherein a plurality of consecutive teeth have upper portions defining a plurality of notches between them.

9. The system of claim 1, wherein at least two consecutive teeth have substantially contiguous roots.

10. The system of claim 9, wherein the roots are substantially contiguous when the application element is viewed from the side.

11. The system of claim 1, wherein at least two consecutive teeth have overlapping roots.

12. The system of claim 11, wherein the roots overlap when the application element is viewed from the side.

13. The system of claim 1, wherein at least first and second consecutive teeth have roots arranged such that part of the root of the first consecutive tooth is at the same axial position along the application element as part of the-root of the second consecutive tooth.

14. The system of claim 1, wherein a top surface of the core is located intermediate a free end of each of the teeth and a bottom end of each of the teeth.

15. The system of claim 1, wherein a cross-section of the core is less than approximately half of the total cross-section of the application element.

16. The system of claim 1, wherein at least one of the teeth has a depth that is greater than its width, the depth being measured perpendicular to the longitudinal axis of the core and the width being measured parallel to the longitudinal axis of the core.

17. The system of claim 1, wherein the teeth are molded as a single piece with the core.

18. The system of claim 17, wherein the teeth and core are molded using plastic.

19. The system of claim 1, wherein the application element is removably attached to the stem.

20. The system of claim 1, wherein the application element is molded as single piece with the stem.

21. The system of claim 1, further comprising a sealing member configured to sealably close the container.

22. The system of claim 21, wherein the sealing member is molded as a single piece with the stem.

23. The system of claim 21, wherein the sealing member includes a cap disposed on the stem.

24. The system of claim 1, wherein the application element is more flexible than the stem.

25. The system of claim 1, wherein the application element is less flexible than the stem.

26. The system of claim 1, wherein the consecutive teeth are arranged alternately on opposite sides of a geometric separation surface.

27. The system of claim 26, wherein the geometric separation surface is a mid-plane of the core.

28. The system of claim 26, wherein the geometric separation surface is a parting line for molding the application element.

29. The system of claim 26, wherein the geometric separation surface is a cylindrical surface.

30. The system of claim 29, wherein a directrix of the cylindrical surface is chosen from a curve and a broken line.

31. The system of claim 26, wherein the geometric separation surface is non-planar.

32. The system of claim 26, wherein the geometric separation surface is twisted.

33. The system of claim 1, wherein at least one of the teeth has at least one face facing toward an end of the application element, the at least one face being disposed at an angle to a longitudinal axis of the core when the application element is viewed from the side.

34. The system of claim 33, wherein the angle is chosen from perpendicular to, acute to, and obtuse to the longitudinal axis of the core.

35. The system of claim 33, wherein at least one face of the teeth on one side of said core is disposed at an angle different from that of at least one face of the teeth on the opposite side of the core.

36. The system of claim 1, wherein the teeth include first and second consecutive teeth, the first consecutive tooth having a free end directed toward a first end of the application element and the second consecutive tooth having a free end directed toward a second end of the application element.

37. The system of claim 1, wherein at least two consecutive teeth have free ends directed toward each other when viewed along the length of the application element.

38. The system of claim 1, wherein at least two consecutive teeth have free ends directed away from each other when viewed along the length of the application element.

39. The system of claim 1, wherein at least two consecutive teeth have free ends substantially parallel to each other.

40. The system of claim 1, wherein at least one of the teeth has one of a convex face and a concave face facing one of the ends of the application element.

41. The system of claim 40, wherein at least two consecutive teeth each has a convex face and a concave face facing one of the ends of the application element.

42. The system of claim 1, wherein one of at least two consecutive teeth has one of a concave face and a convex face facing an end of the application element and the other of the at least two consecutive teeth has a planar face facing the end of the application element.

43. The system of claim 1, wherein the height of the teeth ranges from approximately 0.5 mm to approximately 15 mm.

44. The system of claim 1, wherein the height of the teeth ranges from approximately 7 mm to approximately 13 mm.

45. The system of claim 1, wherein the application element includes a plurality of cores and a plurality of rows of consecutive teeth, the consecutive teeth in each row being alternately disposed on opposite sides of a corresponding core.

46. The system of claim 1, wherein the application element further comprises a base portion on which the teeth and the core are disposed.

47. The system of claim 46, wherein the application element includes a plurality of cores and a plurality of rows of consecutive teeth, the consecutive teeth in each row being alternately disposed on opposite sides of a corresponding core.

48. The system of claim 46, wherein the rows of teeth and corresponding cores are disposed so as to extend substantially in continuation of a side of the base when the base has a polygonal configuration.

49. The system of claim 46, wherein the rows of teeth and corresponding cores are disposed so as to extend substantially at a tangent to the base when the base has a non-polygonal configuration.

50. The system of claim 1, wherein at least one of the teeth has a hollow portion.

51. The system of claim 50, wherein the hollow portion extends along at least a portion of the length of said at least one tooth.

52. The system of claim 51, wherein at least one side of the tooth has an opening leading to the hollow portion.

53. The system of claim 1, wherein at least one of the teeth is flocked.

54. The system of claim 1, wherein the application element has two opposite ends with one of the ends being connected to a distal end portion of the stem.

55. The system of claim 54, wherein the application element has a longitudinal axis substantially parallel to the longitudinal axis of the stem.

56. The system of claim 55, wherein the application element has a longitudinal axis disposed at an angle with respect to a longitudinal axis of the stem.

57. The system of claim 54, wherein the stem includes a connector at the distal end portion, the connector being configured to connect the application element to the stem.

58. The system of claim 1, wherein the application element has two opposite ends and a portion located between the ends is attached to a distal end portion of the stem.

59. The system of claim 58, wherein the application element has a longitudinal axis disposed substantially perpendicular to a longitudinal axis of the stem.

60. The system of claim 58, wherein the stem includes a connector at the distal end portion, the connector being configured to connect the application element to the stem.

61. The system of claim 1, further comprising at least one groove located between at least two adjacent teeth disposed on the same side of the core, said groove extending below a top surface of the core.

62. The system of claim 1, wherein the outer surface of the application element is essentially a cylindrical surface.

63. The system of claim 62, wherein the directrix of the cylindrical surface is a curve formed by the meeting of a semicircle at the bottom and an inverted V at the top.

64. The system of claim 1, wherein the teeth extend over substantially the entire height of the application element.

65. A method for applying a product to eyelashes, comprising:

providing the system of claim 1;

loading a product on at least some of the teeth; and placing at least some of the teeth in contact with the eyelashes such that the product coats the eyelashes.

66. The method of claim 65, wherein the container contains the product and wherein the loading includes inserting the applicator into the container containing the product.

67. The method of claim 66, further comprising removing the applicator from the container and wiping excess product from the teeth.

68. The method of claim 65, wherein the loading includes dispensing the product from the container onto the teeth.

69. The method of claim 65, wherein the loading includes contacting the teeth with a solid cake of product.

70. The method of claim 69, further comprising moistening the solid cake of product.

71. The method of claim 65, further comprising gripping the eyelashes between consecutive teeth.

72. The method of claim 65, wherein the product is mascara.

73. The method of claim 72, wherein the mascara includes fibers, and wherein the method further comprises orienting the fibers with the teeth such that the fibers are substantially parallel to the eyelashes as the product is applied.

74. The method of claim 65, further comprising connecting a portion of the application element of the applicator to the stem of the applicator, the teeth being disposed on the application element.

75. The method of claim 74, further comprising selecting an application element from a plurality of application elements and connecting the application element to the stem.

76. The system of claim 1, further comprising:

a wiper configured to remove excess product from the teeth when the applicator is removed from the container.

77. The system of 76, wherein the wiper is deformable.

78. The system of claim 77, wherein the wiper is chosen from a block of foam and an elastomeric lip.

79. The system of claim 1, wherein the product is contained in the container and the product is a cosmetic product for the eyelashes.

80. The system of claim 79, wherein the product is mascara.

81. The system of claim 1, wherein the container includes an opening configured to permit passage of at least a part of the application element into the container, and wherein the system further comprises a cap at another end of the stem, the cap being configured to sealably close the opening.

82. An applicator for applying a product to eyelashes, comprising:

a stem; and an application element disposed on an end of the stem, said application element including a core having substantially opposite facing sides, a plurality of teeth alternately disposed on the substantially opposite facing sides of the core, and at least one groove defined between two adjacent teeth disposed on the same side of the core, at least a portion of the groove extending on the core, wherein each of the alternately disposed teeth comprises a first end portion and a second end portion opposite to the first end portion along a tooth length, and wherein at least a portion of the core is located above the first end portion and below the second end portion when the application element is oriented such that the second end portion is above the first end portion.

83. The applicator of claim 82, wherein at least a portion of the groove is defined by the adjacent teeth.

84. The applicator of claim 82, wherein the core includes a series of at least two peaks and a valley when the application element is viewed from the side, and the groove is formed by the valley.

85. The applicator of claim 84, wherein the application element further comprises a base portion and the core and the teeth are disposed on the base portion.

86. The applicator of claim 82, wherein root portions of adjacent teeth on one side of the core define at least a portion of the groove.

87. The applicator of claim 86, wherein the root portions of the adjacent teeth are connected to each other.

88. The applicator of claim 86, wherein the root portions of the adjacent teeth are separated from each other.

89. The applicator of claim 82, wherein the groove is substantially V-shaped.

90. The applicator of claim 89, wherein the V-shaped groove opens toward a top surface of the core.

91. The applicator of claim 89, wherein the V-shaped groove opens toward a bottom surface of the core.

92. The applicator of claim 82, wherein the groove is configured to hold the product to be applied.

93. The applicator of claim 82, wherein the groove is in flow communication with a volume defined at least in part by three consecutive teeth, said volume being configured to hold the product to be applied.

94. The applicator of claim 93, wherein the volume is also defined by a portion of the core.

95. The applicator of claim 82, wherein the application element is configured to be inserted into a container containing the product.

96. The applicator of claim 82, wherein the teeth have a height ranging from approximately 0.5 mm to approximately 15 mm.

97. The applicator of claim 82, wherein the teeth have a height ranging from approximately 7 mm to approximately 13 mm.

98. The applicator of claim 82, wherein a ratio of the spacing between two adjacent teeth on the same side of the core and the width of a tooth on the opposite side of the core disposed intermediate the two adjacent teeth ranges from approximately 0.2 to approximately 2.0.

99. The applicator of claim 82, wherein the application element includes a plurality of cores having substantially opposite sides with teeth disposed alternately on opposite sides of each of the cores.

100. An applicator system comprising:

the applicator of claim 82; and a container configured to contain the product.

101. The system of claim 100, further comprising:

a wiper configured to remove excess product from the teeth when the applicator is removed from the container.

102. The system of claim 101, wherein the wiper is deformable.

103. The system of claim 102, wherein the wiper is chosen from a block of foam and an elastomeric lip.

104. The system of claim 100, wherein the product is contained in the container and the product is a cosmetic product for the eyelashes.

105. The system of claim 104, wherein the product is mascara.

106. The system of claim 100, wherein the container includes an opening configured to permit passage of at least a part of the application element into the container, and wherein the system further comprises a cap at another end of the stem, the cap being configured to sealably close the opening.

107. A method for applying a product to eyelashes, comprising:

providing the applicator of claim 82;

loading a product on at least some of the teeth; and placing at least some of the teeth in contact with the eyelashes such that the product coats the eyelashes.

108. The method of claim 107, wherein the loading includes inserting the applicator into a container containing the product.

109. The method of claim 108, further comprising removing the applicator from the container and wiping excess product from the teeth.

110. The method of claim 107, wherein the loading includes dispensing the product from a container onto the teeth.

111. The method of claim 107, wherein the loading includes contacting the teeth with a solid cake of product.

112. The method of claim 111, further comprising moistening the solid cake of product.

113. The method of claim 107, further comprising gripping the eyelashes between consecutive teeth.

114. The method of claim 107, wherein the product is mascara.

115. The method of claim 114, wherein the mascara includes fibers, and wherein the method further comprises orienting the fibers with the teeth such that the fibers are substantially parallel to the eyelashes as the product is applied.

116. The method of claim 107, further comprising connecting a portion of the application element of the applicator to the stem of the applicator, the teeth being disposed on the application element.

117. The method of claim 116, further comprising selecting an application element from a plurality of application elements and connecting the application element to the stem.

118. The method of claim 107, wherein the placing includes contacting the eyelashes with the product contained in the at least one groove on the application element of the applicator.

119. The applicator of claim 82, further comprising a plurality of the grooves on at least one of the opposite facing sides of the core.

120. The applicator of claim 119, wherein the grooves are on both of the opposite facing sides of the core.

121. An applicator for applying a product to eyelashes, comprising:

a stem; and an application element disposed on an end of the stem, said application element including a core having substantially opposite facing sides, a plurality of consecutive teeth alternately disposed on the substantially opposite facing sides of the core, and at least one volume defined by three consecutive teeth and a portion of the core, the volume being configured to hold the product to be applied with the application element, at least a portion of the volume being open to allow the eyelashes to access the product contained therein, wherein each of the alternately disposed teeth comprises a first end portion and a second end portion opposite to the first end portion along a tooth length, and wherein at least a portion of the core is located above the first end portion and below the second end portion when the application element is oriented such that the second end portion is above the first end portion.

122. The applicator of claim 121, wherein the application element further includes a groove at least partially formed in one side of the core.

123. The applicator of claim 122, wherein the groove is in product flow communication with the volume defined by the three consecutive teeth and the portion of the core.

124. The applicator of claim 121, wherein the three consecutive teeth include two teeth on a first side of the core and one tooth on a second side of the core, the volume being partially defined by a space between the two teeth on the first side of the core.

125. The applicator of claim 124, wherein the tooth on the second side of the core is located at a position along a length of the core between respective positions along the length of the core of the two teeth on the first side of the core such that the volume extends in a direction of a longitudinal axis of the core between the two teeth on the first side and in a direction perpendicular to the axis between the tooth on the second side and the two teeth on the first side.

126. The applicator of claim 121, wherein the volume has a substantially open portion defined between two of the consecutive teeth on one side of the core and a substantially closed portion defined by one of the consecutive teeth on the opposite side of the core.

127. The applicator of claim 121, wherein the three consecutive teeth are configured such that at least one of the eyelashes is capable of being substantially gripped between two teeth of the three consecutive teeth disposed on opposite sides of the core.

128. The applicator of claim 121, wherein at least one interstice is formed between two of the three consecutive teeth disposed on opposite sides of the core.

129. The applicator of claim 128, wherein the interstice is configured such that eyelashes entering the interstice are capable of reaching the core.

130. The applicator of claim 128, wherein the interstice is configured such that eyelashes entering the interstice are not capable of reaching the core.

131. The applicator of claim 130, wherein the interstice forms essentially a V-shaped notch.

132. The applicator of claim 121, wherein the teeth have a height ranging from approximately 0.5 mm to approximately 15 mm.

133. The applicator of claim 121, wherein the teeth have a height ranging from approximately 7 mm to approximately 13 mm.

134. The applicator of claim 121, wherein a ratio of the spacing between two adjacent teeth of the three consecutive teeth on the same side of the core and the width of a tooth on the opposite side of the core disposed intermediate the two adjacent teeth ranges from approximately 0.2 to approximately 2.0.

135. An applicator system comprising:

the applicator of claim 121; and a container configured to contain the product.

136. The system of claim 135, further comprising:

a wiper configured to remove excess product from the teeth when the applicator is removed from the container.

137. The system of claim 136, wherein the wiper is deformable.

138. The system of claim 137, wherein the wiper is chosen from a block of foam and an elastomeric lip.

139. The system of claim 135, wherein the product is contained in the container and the product is a cosmetic product for the eyelashes.

140. The system of claim 139, wherein the product is mascara.

141. The system of claim 135, wherein the container includes an opening configured to permit passage of at least a part of the application element into the container, and wherein the system further comprises a cap at another end of the stem, the cap being configured to sealably close the opening.

142. A method for applying a product to eyelashes, comprising:

providing the applicator of claim 121;

loading a product on at least some of the teeth; and placing at least some of the teeth in contact with the eyelashes such that the product coats the eyelashes.

143. The method of claim 142, wherein the loading includes inserting the applicator into a container containing the product.

144. The method of claim 143, further comprising removing the applicator from the container and wiping excess product from the teeth.

145. The method of claim 142, wherein the loading includes dispensing the product from a container onto the teeth.

146. The method of claim 142, wherein the loading includes contacting the teeth with a solid cake of product.

147. The method of claim 146, further comprising moistening the solid cake of product.

148. The method of claim 142, further comprising gripping the eyelashes between consecutive teeth.

149. The method of claim 142, wherein the product is mascara.

150. The method of claim 149, wherein the mascara includes fibers, and wherein the method further comprises orienting the fibers with the teeth such that the fibers are substantially parallel to the eyelashes as the product is applied.

151. The method of claim 142, further comprising connecting a portion of the application element of the applicator to the stem of the applicator, the teeth being disposed on the application element.

152. The method of claim 151, further comprising selecting an application element from a plurality of application elements and connecting the application element to the stem.

153. The applicator of claim 121, further comprising a plurality of the volumes on the application element.

154. The applicator of claim 153, wherein the volumes have open portions alternately facing in opposite directions.

155. An applicator for applying a product to eyelashes, comprising:

a stem; and an application element disposed on an end of said stem, said application element including a core having substantially opposite facing side surface portions extending in a direction parallel to a longitudinal axis of the core, and a plurality of teeth alternately disposed on the substantially opposite facing side surface portions of the core such that at least a portion of each of the teeth on one side of the core are disposed between at least a portion of a pair of respective teeth on the opposite side of the core when the application element is viewed from the side, wherein each of the alternately disposed teeth comprises a first end portion and a second end portion opposite to the first end portion along a tooth length, and wherein at least a portion of the core is located above the first end portion and below the second end portion when the application element is oriented such that the second end portion is above the first end portion.

156. The applicator of claim 155, wherein each of said teeth has a bottom end and a free end and a top of said core is disposed intermediate the bottom end and free end of each of the teeth.

157. The applicator of claim 155, wherein at least a portion of the teeth cover at least part of the opposite facing side surface portions of the core.

158. The applicator of claim 155, wherein the core has a curved longitudinal axis.

159. The applicator of claim 155, wherein the core has a substantially uniform cross-sectional shape at different positions along a length of the core.

160. The applicator of claim 155, wherein the core has a cross-sectional shape that differs at different positions along a length of the core.

161. The applicator of claim 155, wherein the teeth are disposed substantially in a row extending parallel to a longitudinal axis of the core.

162. The applicator of claim 155, wherein the application element includes a plurality of cores and a plurality of rows of teeth disposed with respect to the cores.

163. The applicator of claim 162, wherein the application element includes a base portion and the plurality of cores and corresponding rows of teeth are disposed at different angular positions a round a perimeter of the base portion.

164. The applicator of claim 162, wherein the application element includes a base portion having a polygonal cross-section and each of the cores and corresponding rows of teeth are disposed so as to extend substantially in continuation of different sides of the base portion.

165. The applicator of claim 162, wherein the application element includes a base portion having a non-polygonal cross-section and each of cores and corresponding rows of teeth are disposed so as to extend substantially at a tangent to the base portion.

166. The applicator of claim 155, wherein the teeth and the core are molded as a single piece.

167. The applicator of claim 166, wherein the teeth and the core are molded using plastic.

168. The applicator of claim 155, wherein three consecutive teeth define at least a portion of a volume configured to hold product, the volume having a substantially open portion defined between two of the consecutive teeth disposed on one side surface portion of the core and a substantially closed portion defined by one of the consecutive teeth disposed on the opposite side surface portion of the core.

169. The applicator of claim 155, wherein the teeth have a height ranging from approximately 0.5 mm to approximately 15 mm.

170. The applicator of claim 155, wherein the teeth have a height ranging from approximately 7 mm to approximately 13 mm.

171. The applicator of claim 155, wherein a ratio of the spacing between two adjacent teeth on a same side surface portion of the core and the width of a tooth on an opposite side surface portion of the core disposed intermediate the two adjacent teeth ranges from approximately 0.2 to approximately 2.0.

172. An applicator system comprising:

the applicator of claim 155, and a container configured to contain the product.

173. The system of claim 172, further comprising:

a wiper configured to remove excess product from the teeth when the applicator is removed from the container.

174. The system of claim 173, wherein the wiper is deformable.

175. The system of claim 174, wherein the wiper is chosen from a block of foam and an elastomeric lip.

176. The system of claim 175, wherein the product is contained in the container and the product is a cosmetic product for the eyelashes.

177. The system of claim 176, wherein the product is mascara.

178. The system of claim 172, wherein the container includes an opening configured to permit passage of at least a part of the application element into the container, and wherein the system further comprises a cap at another end of the stem, the cap being configured to sealably close the opening.

179. A method for applying a product to eyelashes, comprising:

providing the applicator of claim 155;

loading a product on at least some of the teeth; and placing at least some of the teeth in contact with the eyelashes such that the product coats the eyelashes.

180. The method of claim 179, wherein the loading includes inserting the applicator into a container containing the product.

181. The method of claim 180, further comprising removing the applicator from the container and wiping excess product from the teeth.

182. The method of claim 179, wherein the loading includes dispensing the product from a container onto the teeth.

183. The method of claim 179, wherein the loading includes contacting the teeth with a solid cake of product.

184. The method of claim 183, further comprising moistening the solid cake of product.

185. The method of claim 179, further comprising gripping the eyelashes between consecutive teeth.

186. The method of claim 179, wherein the product is mascara.

187. The method of claim 186, wherein the mascara includes fibers, and wherein the method further comprises orienting the fibers with the teeth such that the fibers are substantially parallel to the eyelashes as the product is applied.

188. The method of claim 179, further comprising connecting a portion of the application element of the applicator to the stem of the applicator, the teeth being disposed on the application element.

189. The method of claim 188, further comprising selecting an application element from a plurality of application elements and connecting the application element to the stem.

190. An applicator for applying a product to eyelashes, comprising:

a stem; and an application element disposed on an end of said stem, said application element including a core having substantially opposite facing sides, and a plurality of consecutive teeth alternately disposed on the substantially opposite facing sides of the core such that the consecutive teeth are at substantially different positions along the length of the core, wherein each of the alternately disposed teeth comprises a first end portion and a second end portion opposite to the first end portion along a tooth length, and wherein at least a portion of the core is located above the first end portion and below the second end portion when the application element is oriented such that the second end portion is above the first end portion.

191. The applicator of claim 190, further comprising a volume defined by at least three consecutive teeth, the volume being configured to contain the product.

192. The applicator of claim 191, wherein at least a portion of the volume is open to allow the eyelashes to contact product contained in the volume.

193. The applicator of claim 191, wherein a portion of the volume is substantially open on one side of the core and substantially closed on an opposite side of the core.

194. The applicator of claim 193, wherein the open portion of the volume is defined between two of the consecutive teeth disposed on the same side of the core.

195. The applicator of claim 193, wherein the substantially closed portion of the volume is defined by one of the consecutive teeth disposed on a side of the core opposite to two of the consecutive teeth disposed on the same side of the core.

196. The applicator of claim 190, wherein at least a portion of each of the teeth disposed on one side of the core are disposed between at least a portion of a pair of respective teeth disposed on the opposite side of the core when the application element is viewed from the side.

197. The applicator of claim 190, wherein the width of each tooth is less than a space between two adjacent teeth on the same side of the core, the width and the space being measured at a portion of the length of the tooth extending above the core.

198. The applicator of claim 197, wherein an interstice is formed between consecutive teeth when the application element is viewed from the side.

199. The applicator of claim 198, wherein the interstice is configured such that eyelashes entering the interstice are capable of reaching the core.

200. The applicator of claim 199, wherein the interstice has a substantially uniform width from free ends of the consecutive teeth to the core.

201. The applicator of claim 198, wherein the interstice is configured such that eyelashes entering the interstice are prevented from reaching the core.

202. The applicator of claim 201, wherein the interstice has a width that increases in a direction from the core toward the free ends of consecutive teeth.

203. The applicator of claim 202, wherein the interstice forms essentially a V-shaped notch.

204. The applicator of claim 203, wherein a bottom of the notch is located at a distance from a top of the core.

205. The applicator of claim 204, wherein the bottom of the notch is located a distance at least approximately 0.2 mm from the top of the core.

206. The applicator of claim 190, wherein the teeth have substantially planar faces facing the core and substantially curved faces facing away from the core.

207. The applicator of claim 190, wherein the teeth have substantially curved faces facing the core and substantially planar faces facing away from the core.

208. The applicator of claim 190, wherein the application element is substantially flexible.

209. The applicator of claim 190, wherein consecutive teeth have a tapered configuration from a root portion to a free end.

210. An applicator system comprising:

the applicator of claim 190; and a container configured to contain the product.

211. The system of claim 210, further comprising:

a wiper configured to remove excess product from the teeth when the applicator is removed from the container.

212. The system of claim 211, wherein the wiper is deformable.

213. The system of claim 212, wherein the wiper is chosen from a block of foam and an elastomeric lip.

214. The system of claim 210, wherein the product is contained in the container and the product is a cosmetic product for the eyelashes.

215. The system of claim 214, wherein the product is mascara.

216. The system of claim 210, wherein the container includes an opening configured to permit passage of at least a part of the application element into the container, and wherein the system further comprises a cap at another end of the stem, the cap being configured to sealably close the opening.

217. A method for applying a product to eyelashes, comprising:

providing the applicator of claim 190;

loading a product on at least some of the teeth; and placing at least some of the teeth in contact with the eyelashes such that the product coats the eyelashes.

218. The method of claim 217, wherein the loading includes inserting the applicator into a container containing the product.

219. The method of claim 218, further comprising removing the applicator from the container and wiping excess product from the teeth.

220. The method of claim 217, wherein the loading includes dispensing the product from a container onto the teeth.

221. The method of claim 217, wherein the loading includes contacting the teeth with a solid cake of product.

222. The method of claim 221, further comprising moistening the solid cake of product.

223. The method of claim 217, further comprising gripping the eyelashes between consecutive teeth.

224. The method of claim 217, wherein the product is mascara.

225. The method of claim 224, wherein the mascara includes fibers, and wherein the method further comprises orienting the fibers with the teeth such that the fibers are substantially parallel to the eyelashes as the product is applied.

226. The method of claim 217, further comprising connecting a portion of the application element of the applicator to the stem of the applicator, the teeth being disposed on the application element.

227. The method of claim 226, further comprising selecting an application element from a plurality of application elements and connecting the application element to the stem.

* * * * *

UNITED STATES PATENT AND TRADEMARK OFFICE

CERTIFICATE OF CORRECTION

PATENT NO. : 6,412,496 B1
DATED : July 2, 2002
INVENTOR(S) : Jean-Louis H. Gueret It is certified that error appears in the above-identified patent and that said Letters Patent is hereby corrected as shown below:

Column 18,
Line 8, replace “the-root” with -- the root --;

Column 20,
Line 62, after “The system of” insert -- claim --; and

Column 25,
Line 57, replace “a round” with -- around --.

Signed and Sealed this

Tenth Day of December, 2002

JAMES E. ROGAN
*Director of the United States Patent and Trademark Office*